US007730691B2

(12) United States Patent
Patrick

(10) Patent No.: US 7,730,691 B2
(45) Date of Patent: Jun. 8, 2010

(54) BUILDING PANEL REPAIR

(76) Inventor: Alan John Patrick, Castlehouse, Allanfauild Road, Kilsyth, Glasgow (GB) G65 9DE ( * ) Notice: Subject to any disclaimer, the term of this patent is extended or adjusted under 35 U.S.C. 154(b) by 768 days.

(21) Appl. No.: 11/148,068

(22) Filed: Jun. 8, 2005

(65) Prior Publication Data

US 2006/0010816 A1 Jan. 19, 2006

(30) Foreign Application Priority Data

Jul. 13, 2004 (GB) ..... 0415594.1
May 18, 2005 (GB) ..... 0510126.6

(51) Int. Cl.
*E02D 37/00* (2006.01)

(52) U.S. Cl. ..... 52/514; 52/366; 52/741.41

(58) Field of Classification Search ..... 52/514, 52/514.5, 741.41, 127.4, 345, 105, 366, 742.1, 52/346; 156/71
See application file for complete search history.

(56) References Cited

U.S. PATENT DOCUMENTS 1,669,541 A * 5/1928 Spreen ..... 52/514
1,856,030 A * 4/1932 Loeffler ..... 52/391
3,874,505 A * 4/1975 Mirarchi et al. ..... 206/582
3,999,347 A * 12/1976 Devlin ..... 52/514
4,083,258 A 4/1978 Hammett et al.
4,193,243 A 3/1980 Tiner
4,285,183 A 8/1981 Condit et al.
4,297,823 A * 11/1981 Keisler ..... 52/514
4,460,420 A 7/1984 Estrada
4,641,474 A * 2/1987 Cannarsa ..... 52/514
4,809,478 A 3/1989 Bernard
5,007,223 A 4/1991 Holland
5,018,331 A * 5/1991 Forzano ..... 52/514
5,269,861 A * 12/1993 Gilbreath ..... 156/98
5,299,404 A 4/1994 Jabro
5,474,347 A * 12/1995 Vigneault et al. ..... 292/340
5,687,528 A * 11/1997 Rouch ..... 52/514
5,778,624 A * 7/1998 Russell ..... 52/514
5,960,603 A 10/1999 Redden et al.
6,209,277 B1 * 4/2001 DiGate ..... 52/514
6,231,949 B1 5/2001 Hoffmann, Sr.
6,594,967 B1 7/2003 Panahii

FOREIGN PATENT DOCUMENTS

CA 1319236 6/1993
GB 2407613 5/2005

* cited by examiner

*Primary Examiner*—Richard E Chilcot, Jr.
*Assistant Examiner*—Chi Q Nguyen
(74) *Attorney, Agent, or Firm*—James Creighton Wray; Meera P. Narasimhan

(57) ABSTRACT

Building panel repair apparatus generally includes a substantially planar backplate for insertion through a hole in a building panel to be repaired. A front face of the backplate is provided with adhesive for mounting the backplate to the rear side of a building panel. At least one flap is defined in the backplate such that the at least one flap is movable between an open position providing an operative with backplate positioning means to facilitate mounting of the backplate to a building panel, and a closed position providing a substrate surface for hole repair material. Other aspects of the invention include methods of repairing building panels using a building panel repair apparatus, and methods of manufacturing building repair apparatus.

20 Claims, 27 Drawing Sheets

BUILDING PANEL REPAIR

CROSS-REFERENCE TO RELATED APPLICATIONS

This application claims priority to United Kingdom Patent Application No. 04 15 594.1, filed 13 Jul. 2004, the entire disclosure of which is incorporated herein by reference in its entirety as if fully set forth herein. This application also claims priority to United Kingdom Patent Application No. 05 10 12.6, filed May 18, 2005.

FIELD OF THE INVENTION

The present invention relates to building panel repair, in particular to apparatus for use in building panel repair, a method of building panel repair and a method of manufacture of apparatus for use in building panel repair.

BACKGROUND OF THE INVENTION

A first technique for repairing a hole in a building panel, such as a wallboard or drywall, involves filling the hole with scrunched up paper or a piece of wood and applying layers of plaster until the repair is considered to be satisfactory.

A problem with this technique is the unpredictability of the integrity of the repair. The technique involves an irregular distribution of plaster throughout the restoration area. A differential cure rate across the repair, due to different depths of plaster within the filled hole or fluctuations in temperature and humidity, is a contributing factor towards cracking.

In addition, during curing, plaster contracts and the application of an insufficient quantity of plaster in an area can also lead to cracking. The technique also involves the use of a porous fill material, and absorption of water from the plaster by the fill material can lead to dehydration cracking. The potential quality of the repair is deteriorated during curing by interacting factors contributing towards cracking, often leading to a repair of unsatisfactory quality requiring patching.

A second technique for repairing a hole in a hollow building panel described in U.S. Pat. No. 4,193,243 involves the insertion of a perforated sheet through the hole and is then mounted to the building panel using a tool and rod arrangement inserted through the perforated sheet. A problem with this technique is that the tool and rod arrangement may become lost or broken in a building environment and is inconvenient to use. Following mounting of the perforated sheet, the outer portion of the rod must be broken off and the tool removed. This is inconvenient in practice and may weaken the quality of the mounting of the perforated sheet to the building panel. In addition, the apparatus used in the repair presents an obstruction to subsequent mounting of an object to the repaired area of the building panel.

A third technique for repairing a hole in a building panel involves applying a mesh patch to the front surface of the building panel to cover over the hole and to which plaster or other compound is then applied. When dry, the plaster or other compound is sanded down. A disadvantage with this technique is that in most cases, a bump is left on the building panel surface. Such a bump may present an obstacle if tiling over the repair. Furthermore, a relatively small amount of plaster or other compound is used to complete the repair. This characteristic of the repair renders the repair susceptible to damage, for example, in the event an object strikes the building panel in the area of the repair, and also reduces the ability of the building panel to support fixings in the area of the repair.

SUMMARY OF THE INVENTION

According to a first aspect of the present invention there is provided apparatus for use in building panel repair. In one exemplary embodiment, the apparatus generally includes a substantially planar backplate for insertion through a hole in a building panel to be repaired. A front face of the backplate is provided with adhesive for mounting the backplate to the rear side of a building panel. At least one flap is defined in the backplate. The at least one flap is movable between a first open position providing an operative with backplate positioning means to facilitate mounting of the backplate to a building panel, and a second closed position providing a substrate surface for hole repair material.

According to a second aspect of the present invention there is provided methods of building panel repair with an apparatus including a substantially planar backplate for insertion through a hole in a building panel to be repaired. A front face of the backplate is provided with adhesive for mounting the backplate to a rear face of a building panel. At least one flap is defined in the backplate such that the flap is movable between a first open position providing an operative with backplate positioning means to facilitate mounting of the backplate to a building panel and a second closed position providing a substrate surface for hole repair material. In one exemplary implementation, a method of repairing a building panel generally includes the steps of inserting the backplate through a hole in a building panel; with a flap in the first open position, positioning the front face of the backplate to face the rear face of the building panel; with the adhesive provided on the front face of the backplate exposed, pulling the front face of the backplate against the rear face of the building panel to mount the backplate; moving the flap into the second closed position; and applying hole repair material to the exposed surface of the mounted backplate.

According to a third aspect of the present invention there is provided methods of manufacturing apparatus having a substantially planar backplate for insertion through a hole in a building panel to be repaired. A front face of the backplate is provided with adhesive for mounting the backplate to a rear face of a building panel. At least one flap is defined in the backplate such that the at least one flap is movable between a first open position providing an operative with backplate positioning means to facilitate mounting of the backplate to a building panel and a second closed position providing a substrate surface for hole repair material. In one exemplary implementation, the method of manufacturing generally includes the steps of adhering one side of two-sided adhesive tape to one side of a backplate sheet; and cutting through the backplate sheet to define at least one flap.

Further aspects and features of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF EXEMPLARY EMBODIMENTS

The following description of various embodiments is merely exemplary in nature and is in no way intended to limit the invention, its applications, or uses.

Figure 1:
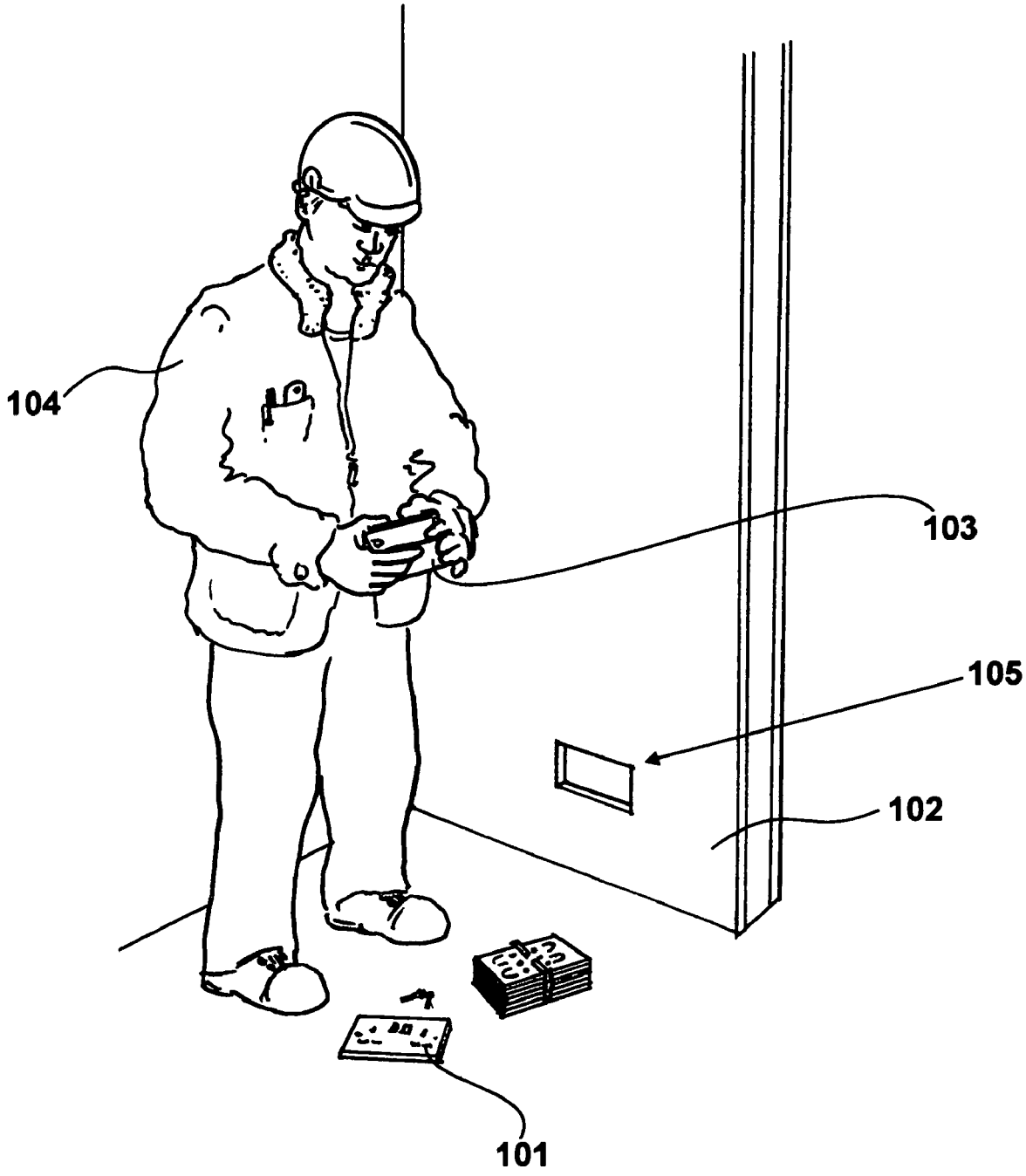
FIG. 1 shows apparatus for use in building panel repair and a building panel to be repaired according to one exemplary embodiment of the invention.

FIG. 1 shows repair apparatus 101 for use in building panel repair. A building panel 102 requires repair. In this example, an electrical fitting 103 has been removed from building panel 102 by building operative 104, leaving an unwanted aperture 105.

The repair apparatus comprises a substantially planar backplate for insertion through a hole in a building panel to be repaired. A front face of the backplate is provided with adhesive for mounting the backplate to the rear side of a building panel. At least one flap is defined in the backplate movable between a first open position, providing an operative with backplate positioning means to facilitate mounting of the backplate to a building panel, and a second closed position providing a substrate surface for hole repair material.

Figure 2:
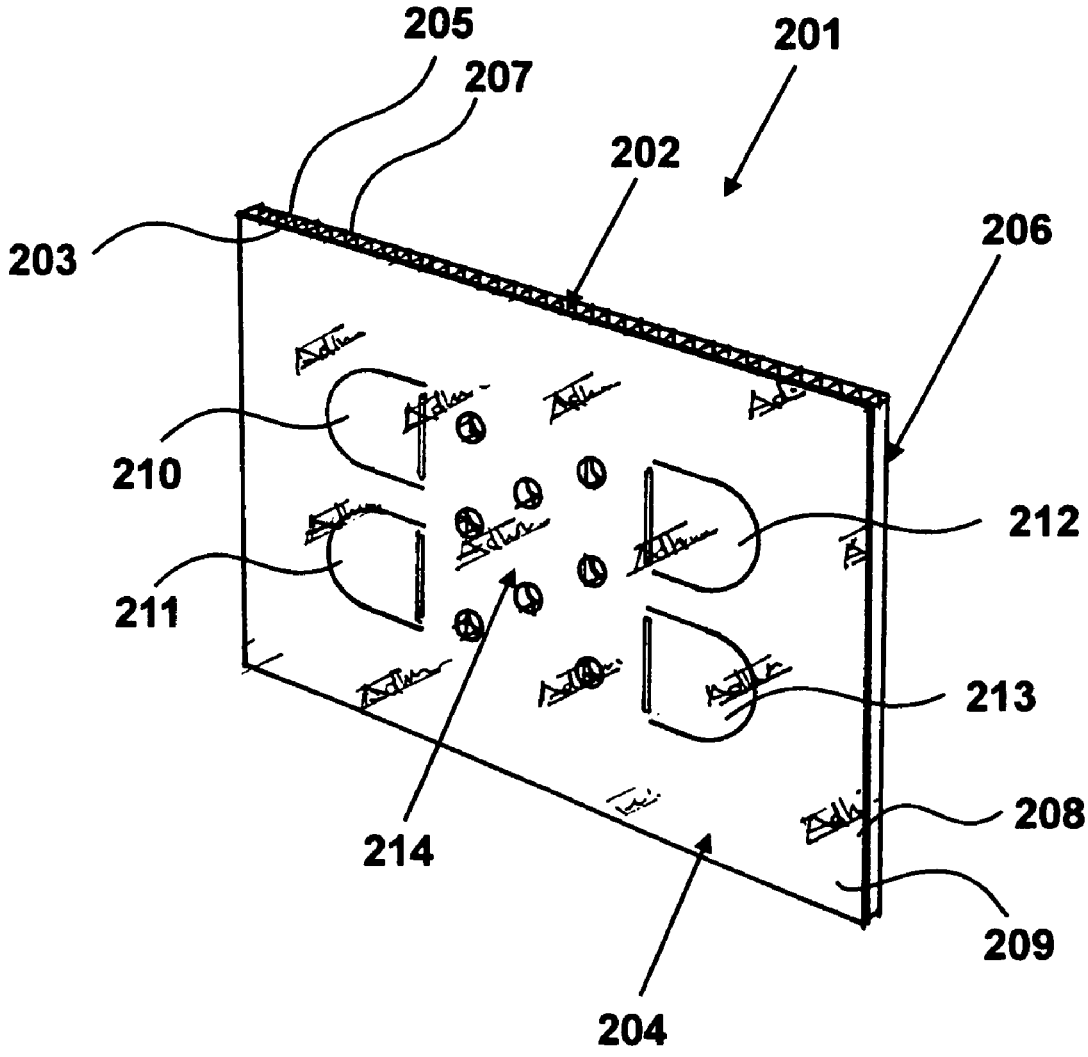
FIG. 2 shows repair apparatus for use in repairing a hole in a building panel.

An enlarged view of a repair apparatus 201 is shown in FIG. 2. Repair apparatus 201 comprises a substantially rectangular planar backplate 202. According to the present embodiment, backplate 202 is fabricated from plastic board having a twin wall structure. The structure comprises a first front wall 203, providing a front face 204, spaced apart from a second rear wall 205, providing a rear face 206, by a plurality of connecting members, known as flutes, extending between the walls 203, 205, for example connecting member 207.

The front face 204 of backplate 202 is provided with two-sided adhesive tape 208. The tape 208 includes one side adhered to the front face 204 of backplate 202 and the opposite side provided with a removable backing 209. Substantially the whole of front face 204 is provided with adhesive.

According to the present embodiment, four flaps 210, 211, 212, 213 are defined in the backplate 202. The flaps 210, 211, 212, 213 are arranged in two pairs; a first pair comprising flap 210 and nearest adjacent flap 211 and a second pair comprising flap 212 and nearest adjacent flap 213. According to the shown arrangement, the flaps forming first pair 210, 211 and second pair 212, 213 open in the same direction as each other, however the flaps in the first pair 210, 211 open in a different direction, the opposite direction, to the flaps of the second pair 212, 213.

In FIG. 2, each of the flaps 210, 211, 212, 213 is shown in a fully closed position, in which the flap lies flush in the plane of the backplate 202. The flaps 210, 211, 212, 213 open inwardly; the distal end of each flap 210, 211, 212, 213 is rotatable from the fully closed position towards the center of the backplate 202. The distal end of an outwardly opening flap is rotatable from the fully closed position away from the center of the backplate, towards an edge.

The repair apparatus may also feature at least one repair material aperture. According to the present embodiment, an array of repair material apertures 214 is defined in backplate 202. In this example, the array of hole repair material apertures 214 is located substantially centrally of front face 204 with the first pair of flaps 210, 211 located to one side of the array 214 and the second pair of flaps 212, 213 located to the other side of the array 214. Thus, in this example, the flaps 210, 211, 212, 213 open inwardly towards the array of repair material apertures 214.

Figure 3:
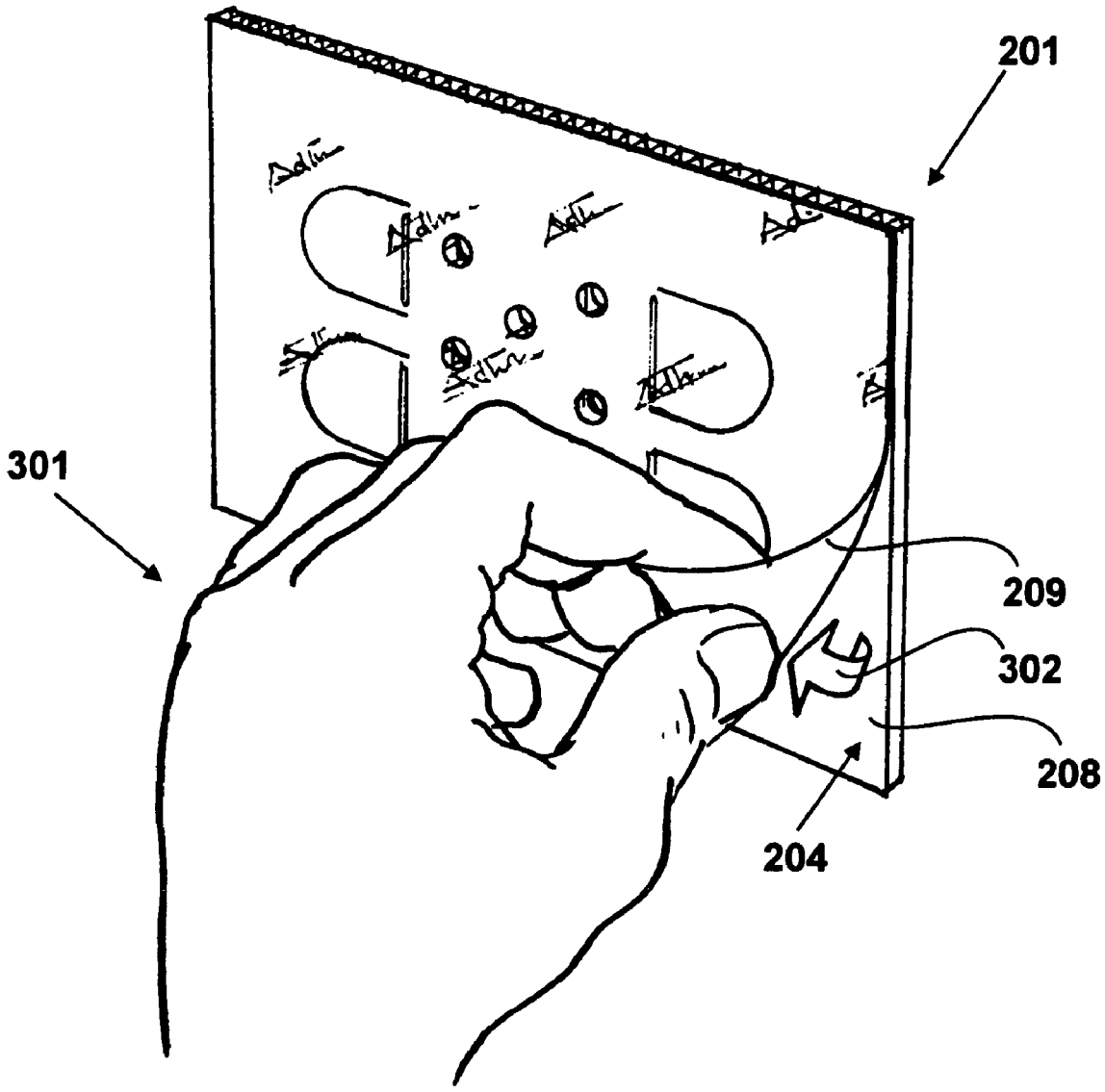
FIG. 3 shows a first preparation step in using the apparatus of FIG. 2.

FIG. 3 illustrates a first preparation step in using repair apparatus 201. The front face 204 of the backplate 202 is prepared for mounting to a building panel.

An adhesive surface of adhesive tape 208 on the front face 204 of backplate 202 is exposed through removal of the removable backing 209. As shown, a building operative 301 can achieve this by lifting a corner of the removable backing 209 up from a corner of the front face 204 of the backplate 202 and peeling it back across the front face 204, as indicated by arrow 302.

Figure 4:
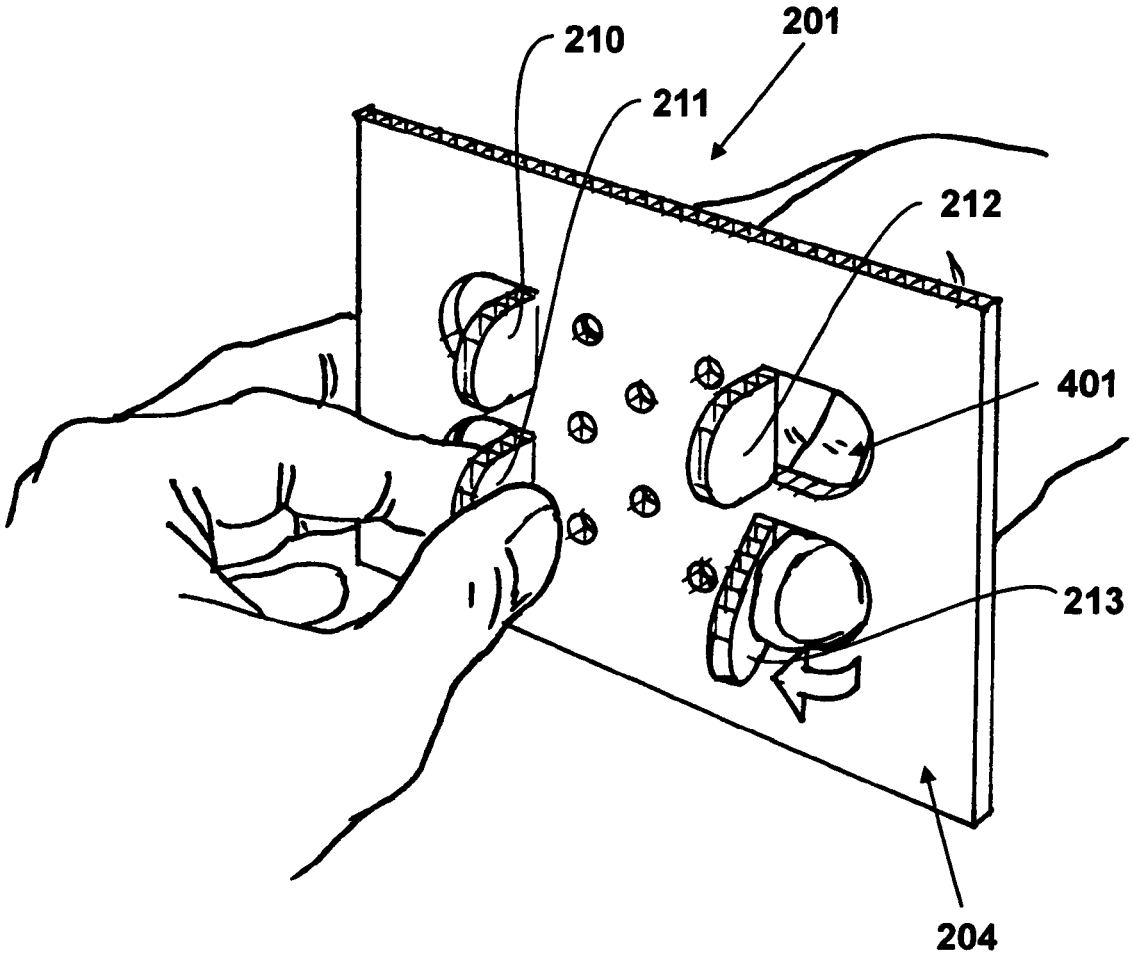
FIG. 4 shows a second preparation step in using the apparatus of FIG. 2.

A second preparation step in using repair apparatus 201 is illustrated in FIG. 4. The flaps 210, 211, 212, 213 of the backplate 202 are reconfigured to provide backplate positioning means.

Each of the flaps 210, 211, 212, 213 is moved from the closed position shown in FIG. 2, into an open position. When opened, each flap 210, 211, 212, 213 is manually grippable, allowing an operative to grip a flap to gain hold of the backplate 202. Furthermore, moving a flap 210, 211, 212, 213 from the closed position into an open position leaves behind a flap aperture through the backplate 202, for example flap aperture 401, allowing an operative to hook a finger through to gain hold of the backplate. In this example, the flaps of each pair 210, 211 and 212, 213 open in the same direction as each other, for ease of use.

In FIG. 4, each of the flaps 210, 211, 212, 213 are shown in a forward open position in which the flap extends forwardly of front face 204. Flaps 210, 211 and 212 are each shown in a forward open position in which the flap extends substantially normal to the front face 204 of the backplate 202. As shown, a building operative 301 can achieve reconfiguration of the flaps 210, 211, 212, 213 from the fully closed position into a forward open position by pushing the side of the flap flush with the rear face 206 of the backplate 202 forward through the backplate 202 to the front face 204 side.

The backplate positioning means presented following reconfiguration of the flaps 210, 211, 212, 213 into an open position functions to assist an operative in positioning the backplate for mounting, and thus facilitates the mounting of the backplate to a building panel.

Figure 5:
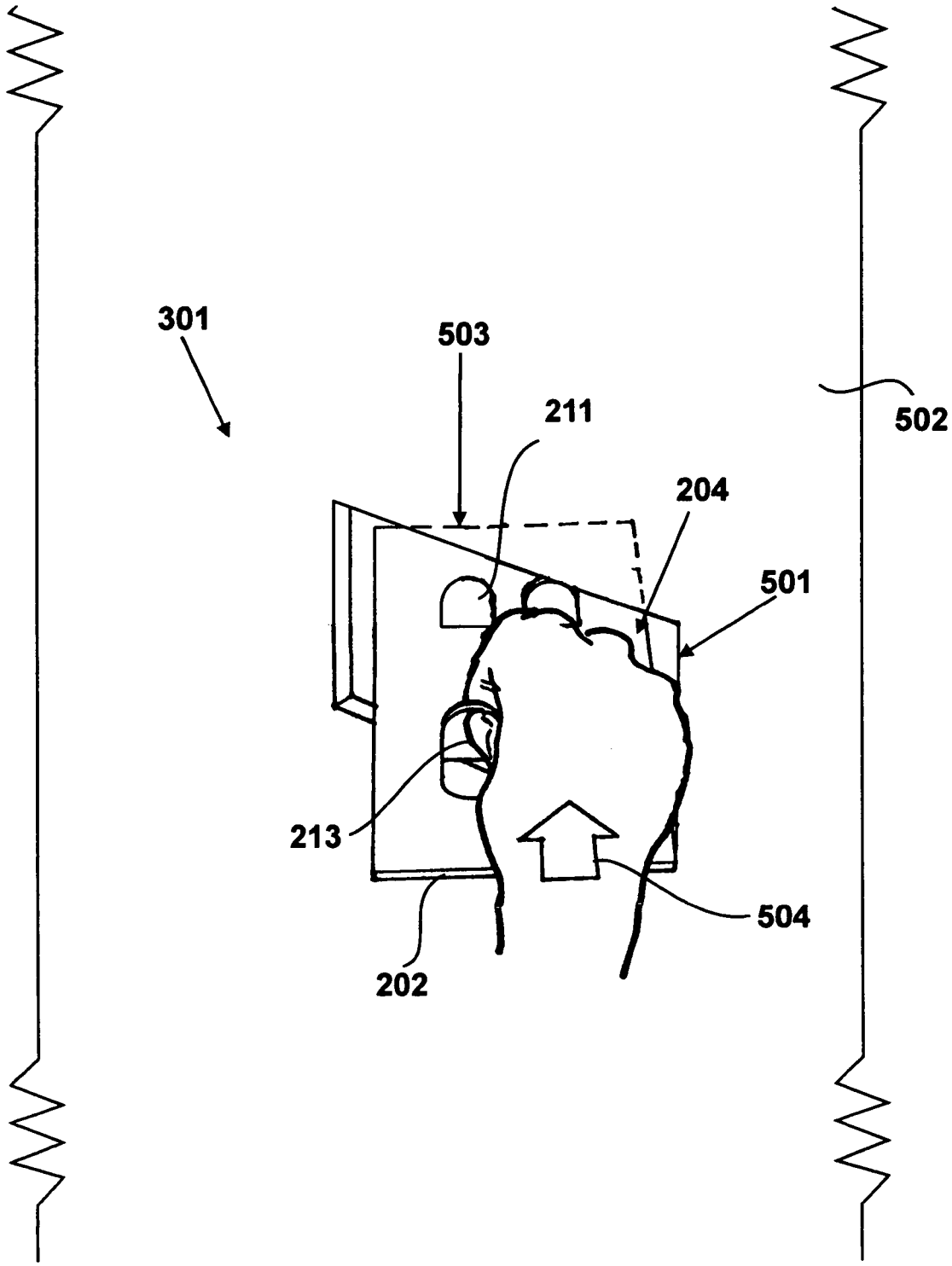
FIG. 5 shows a third step in using the apparatus of FIG. 2 in which the backplate is inserted through a hole in a building panel to be repaired.

FIG. 5 illustrates a third step in using repair apparatus 201. The backplate 202 is inserted through a hole 501 in a building panel 502 to be repaired. In this example, building panel 502 is an internal plasterboard wall.

The width and length dimensions of backplate 202 are greater than the corresponding dimensions of the hole 501 in the building panel 502. However, the backplate 202 can be inserted through the hole 501 when oriented with a width edge 503 leading. As shown, a building operative 301 can achieve this by using one or both hands to grip one or more of the flaps 210, 211, 212, 213 and, whilst holding the flap(s), orienting the backplate 202 for insertion into the hole 501 and then passing the backplate 202 from the front side of the building panel 502 through the hole 501 to the rear side of the building panel 502, as indicated by arrow 504. The backplate may be flexed to facilitate insertion through the hole.

As previously described, substantially the whole of front face 204 is provided with adhesive. With this arrangement, the front surface of each flap 210, 211, 212, 213 is provided with adhesive. Each flap 210, 211, 212, 213 presents an adhesive surface that will stick to a human finger. This feature functions to reduce the risk of the backplate dropping behind a building panel during positioning for mounting.

Figure 6:
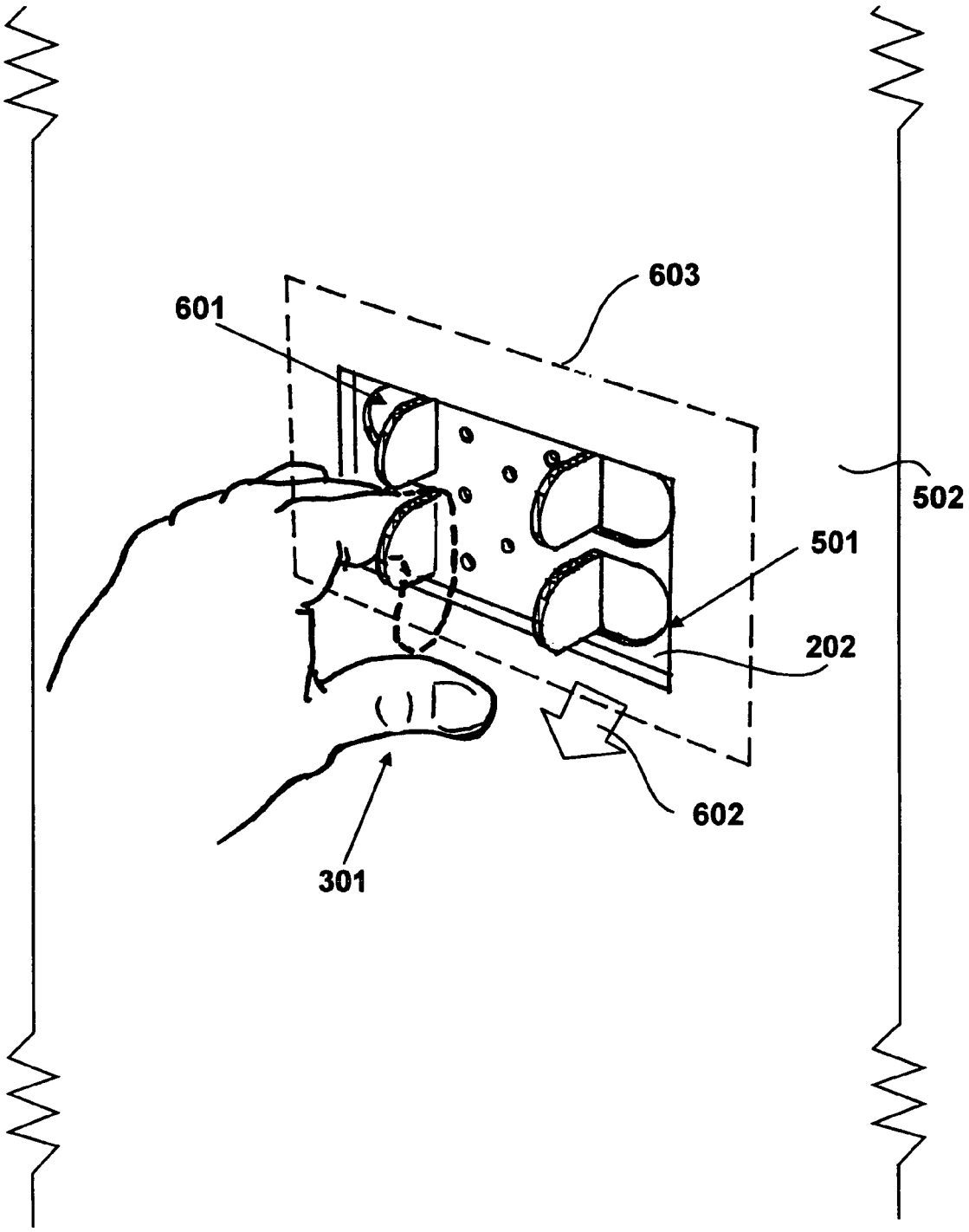
FIG. 6 shows a fourth step in using the apparatus of FIG. 2 in which the backplate is mounted to the building panel being repaired.

A fourth step in using repair apparatus 201 is illustrated in FIG. 6. The backplate 202 is mounted to the building panel 502 to be repaired.

The front face 204 of the backplate 202 is adhered to the rear side of the building panel 502. As shown, a building operative can achieve this by orienting front face 204 of backplate 202 to face the rear side of the building panel 502, hooking a finger through a flap aperture, for example flap aperture 601, and pulling backplate 202 forward into contact with the building panel 502; as indicated by arrow 602. Alternatively, the pulling action can be effected whilst holding the backplate 202 using the flaps 210, 211, 212, 213.

Dotted line boundary 603 indicates the position of the edges of the backplate 202 relative to the hole 501 in the building panel 502 following mounting.

Figure 7:
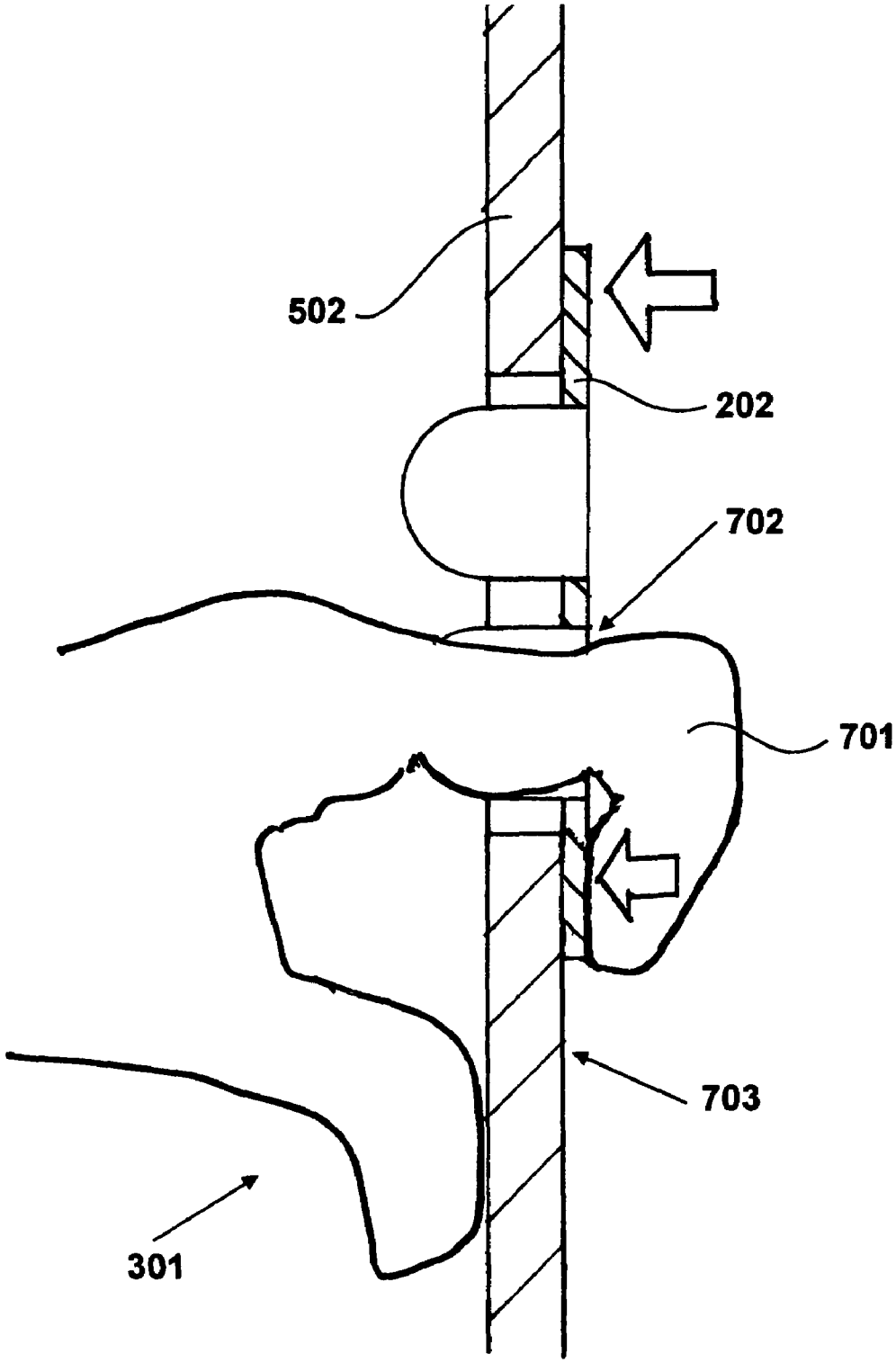
FIG. 7 shows a cross-section view of the illustration of FIG. 6.

A cross-section view of FIG. 6 is shown in FIG. 7. By hooking a finger 701 through a flap aperture (for example flap aperture 702 of backplate 202) building operative 301 can press the backplate 202 into contact with the rear side 703 of building panel 502 directly. This feature functions to increase the security of the mounting of the backplate to the building panel.

In addition, the feature of substantially the whole of front face 204 being provided with adhesive also functions to increase the security of the mounting by increasing the potential area of the backplate 202 adhered to the building panel during mounting. This adhesive arrangement is particularly useful in the instance that a dry patch of plasterboard can be inserted into the repair, with the repair being completed by a plaster skim around the edges. Such an adhesive arrangement is also useful in the instance that prior cleaning of the rear side of the building panel to which the backplate is to be mounted has not been performed, and the rear side of the building panel has dust or debris attached.

The backplate can also be fixed in position using screws, for example standard plasterboard screws, or other suitable fasteners. This feature is particularly useful in cases where the rear side of the building panel is damaged or damp. A screw fixing to secure the backplate to the building panel provides for a repair that is as effective as when the backplate is secured by adhesive only.

Figure 8:
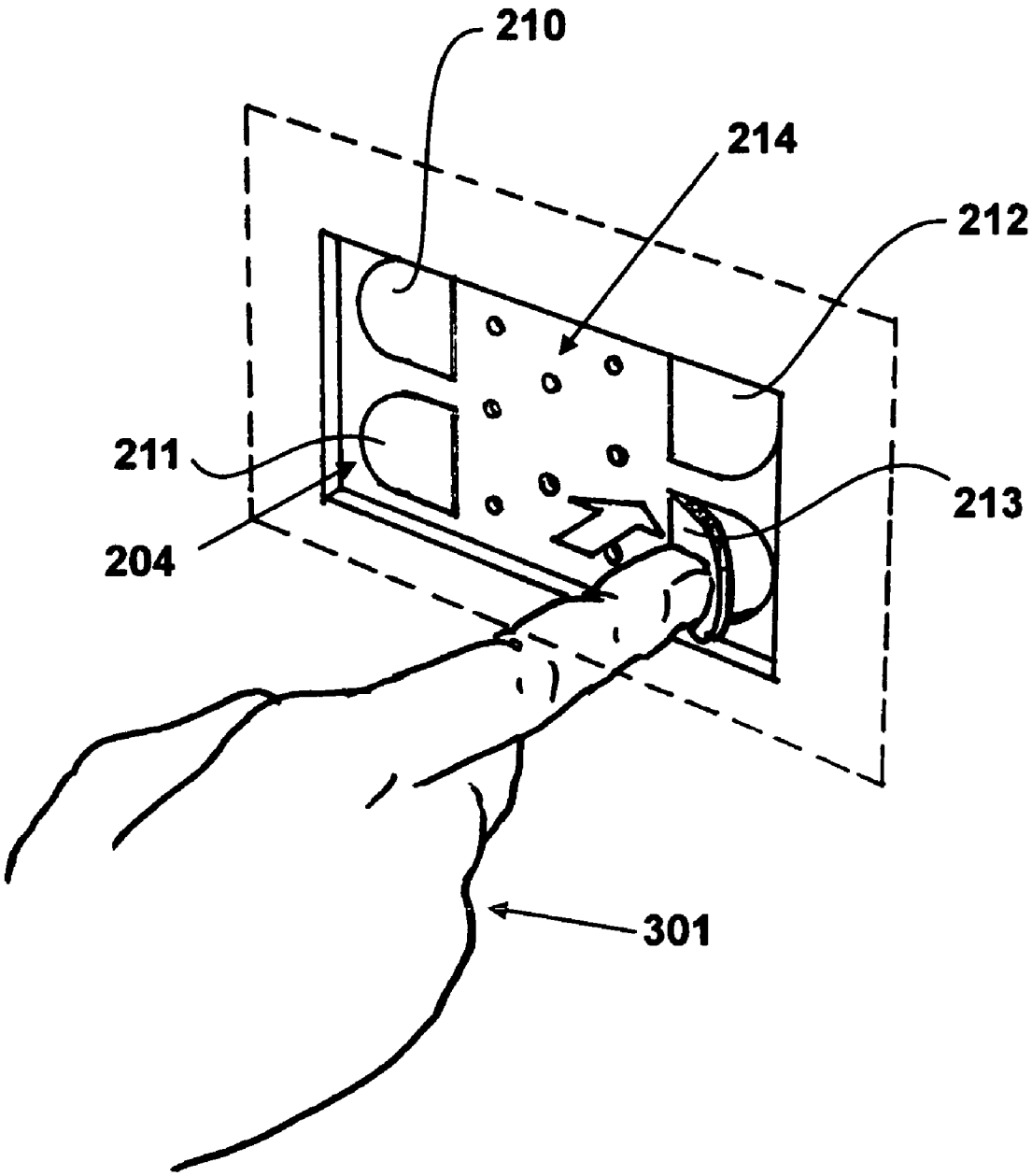
FIG. 8 shows a fifth step in using the apparatus of FIG. 2.

In FIG. 8, a fifth step in using repair apparatus 201 is illustrated. Following installation, the flaps 210, 211, 212, 213 of backplate 202 are reconfigured to provide a substrate surface for hole repair material. Each of the flaps 210, 211, 212, 213 is moved from the open position shown in FIG. 4, into a closed position, preferably the fully closed position shown in FIG. 2.

As shown, a building operative 301 can achieve reconfiguration of the flaps 210, 211, 212, 213 from the open position into the closed position by pushing the front of a flap 210, 211, 212, 213 from the front face side of the backplate 202 backwards into the plane of the front face 204 of backplate 202 to close the associated flap aperture.

As previously described, each flap 210, 211, 212, 213 presents an adhesive surface to which a human finger may stick. However, an operative may wish to prevent a finger sticking to a flap, for example to facilitate removal of the finger following flap closure. An operative can establish a dust barrier against the adhesive by drawing a fingertip along the chalky edge of the hole to be repaired or other dusty area.

The repair apparatus may also feature at least one flap with a directional fold. According to the present embodiment, each of the flaps 210, 211, 212, 213 of repair apparatus 201 has a directional fold, the flap being inhibited from being movable through the backplate 202. In particular, backplate 202 is configured to inhibit each flap 210, 211, 212, 213 from being movable from the closed position through to the rear face side of the backplate 202. This feature functions to facilitate the reconfiguration of each flap 210, 211, 212, 213 of the mounted backplate 202 into the closed position, by inhibiting movement beyond the fully closed position.

With the flaps 210, 211, 212, 213 in the closed position, the exposed area of the front face 204 is effectively substantially continuous, with the exception of the array of repair material apertures 214.

The mounted backplate functions to provide a stable surface to which curable hole repair material can be applied. The backplate serves to maintain the hole repair material in position until cured, and then to provide support for the cured hole repair material.

Figure 9:
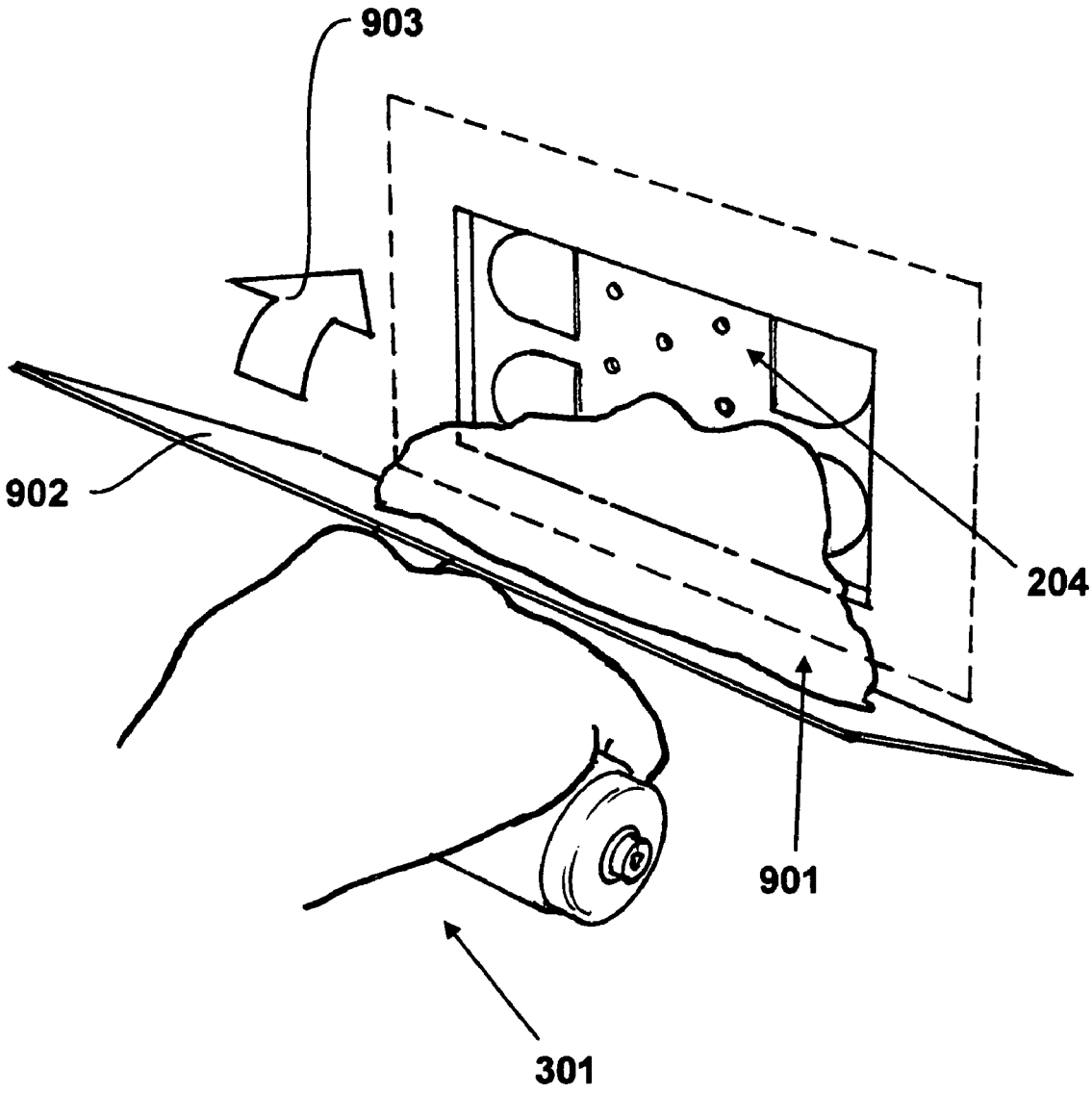
FIG. 9 shows a sixth step in using the apparatus of FIG. 2 in which hole repair material is applied to the mounted backplate of FIG. 8.

A sixth step in using the repair apparatus 201, in which curable hole repair material is applied to the mounted backplate of FIG. 8, is illustrated in FIG. 9. As shown, a building operative 301 can achieve this by loading hole repair material 901 onto a trowel 902 and then applying the hole repair material 901 to the exposed area of front face 204 of mounted backplate 202 using the trowel 902 (as indicated by arrow 903). In this example, hole repair material 901 is plaster of paris, although other suitable hole repair materials can be used.

Figure 10:
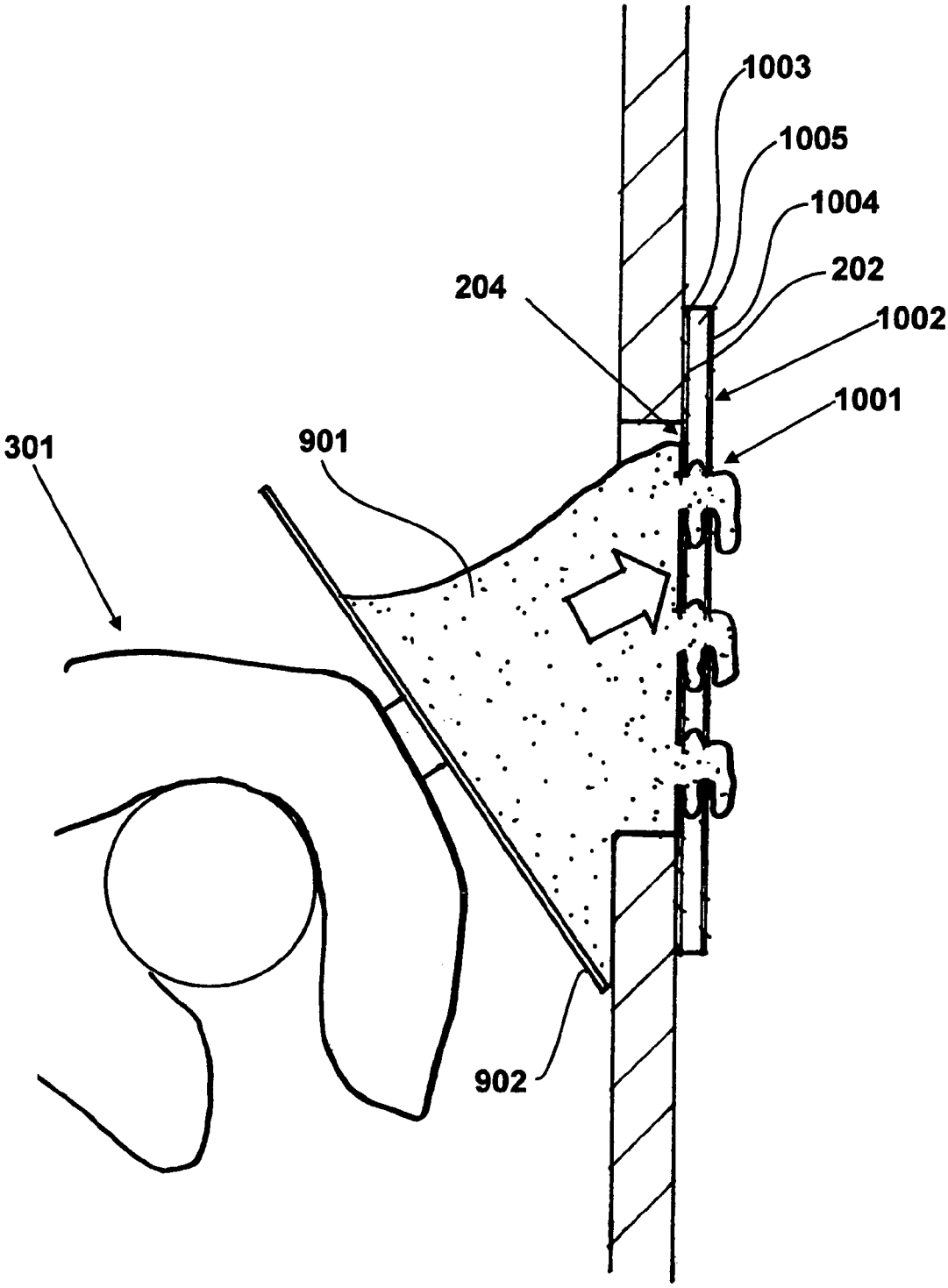
FIG. 10 shows a cross-section view of hole repair material being applied to the mounted backplate of FIGS. 8 and 9.

FIG. 10 shows a cross-section view of hole repair material being applied to the mounted backplate 202 of FIGS. 8 and 9. As shown, the repair material apertures of repair material aperture array 214, for example repair material aperture 1001, are each arranged to receive hole repair material 901.

As hole repair material 901 is applied to front face 204 of backplate 202, in addition to being received in repair material aperture 1001, hole repair material 901 may flow through the backplate 202 to the rear face 1002 of the backplate 202. It is then acted upon by gravity to a degree depending on the composition and consistency of the hole repair material, encouraging further flow. This feature functions to interlock the backplate with the hole repair material.

As previously described, backplate 202 has a twin wall structure. Backplate 202 has a substantially hollow construction 1005 allowing hole repair material 901 received in a repair material aperture 1001 to flow downwards between the walls 1003, 1004 under gravity. This feature functions to interlock backplate 202 with hole repair material 901. The arrangement of the connecting members of the backplate may encourage downward flow of hole repair material. According to the example shown, the connecting members of backplate 202 are spaced apart substantially parallel with each other, in the orientation shown, extending substantially vertically.

Figure 11:
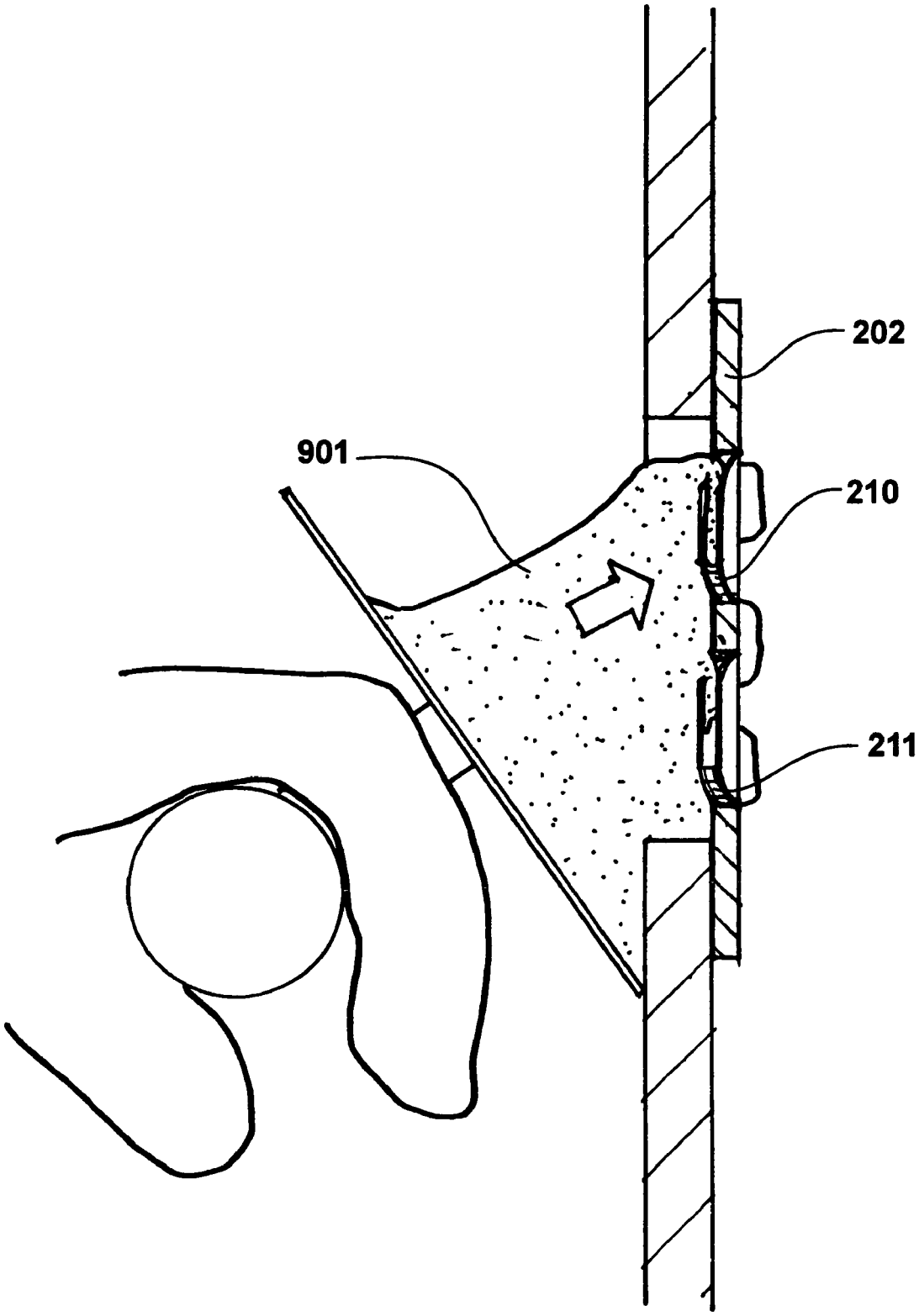
FIG. 11 shows a cross-section view of hole repair material being applied to a mounted backplate.

FIG. 11 shows a cross-section view of hole repair material 901 being applied to mounted backplate 202 in an alternative scenario in which the flaps 210, 211, 212, 213 are not in the fully closed position. With the flaps 210, 211, 212, 213 extending in a different plane to that of backplate 202, hole repair material 901 may flow into the gap between each flap 210, 211, 212, 213 and the backplate 202. In addition, due to the twin wall construction of backplate 202, hole repair material 901 may flow into the flaps 210, 211, 212, 213. These features function to interlock backplate 202 with hole repair material 901. Interlocking of the backplate with the hole repair material provides for a more secure repair.

Figure 12:
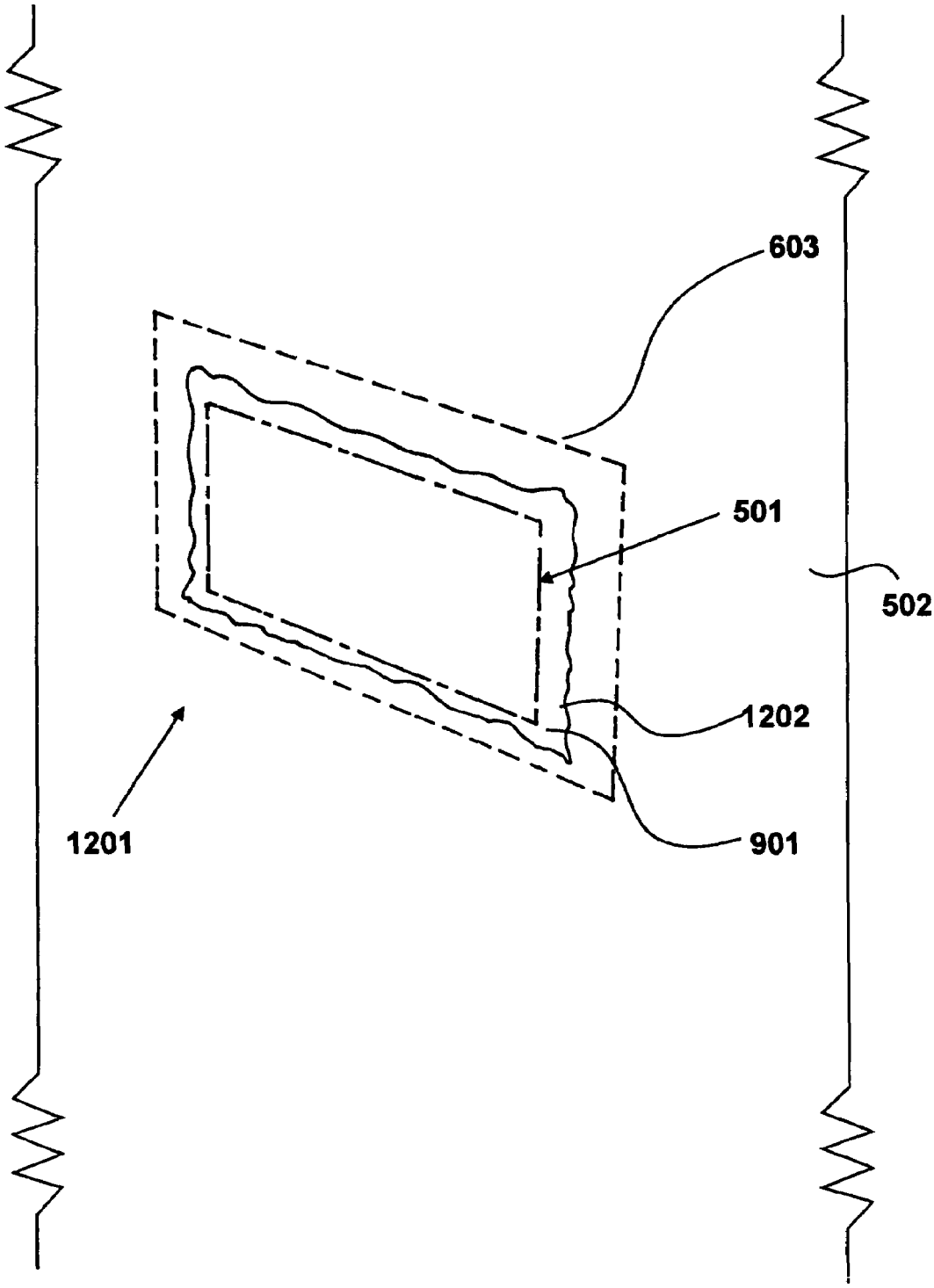
FIG. 12 shows a building panel following repair using the apparatus of FIG. 2.

FIG. 12 shows the repair 1201 in building panel 502, using repair apparatus 201 and hole repair material 901 in accordance with the method as described with reference to FIGS. 3 to 11.

Dotted line boundary 603 indicates the position of the edges of the backplate 202 relative to the hole 501 in the building panel 502. Line 1202 indicates the boundary of the applied hole repair material 901. A sufficient quantity of hole repair material 901 has been applied to the backplate 202 to fill the cavity between the front face 204 of backplate 202 and the front side of the building panel 502. Additional hole repair material 901 has been spread across the restored cavity, beyond the boundary of the hole 501 onto the front face of building panel 502 to seal the repair. A satisfactory repair can be attained using traditional plaster or patch compound. Typically, two coats of hole repair material will be expected to complete a satisfactory repair.

The adhesive on the front face 204 of backplate 202 provides a surface to which hole repair material may adhere more strongly than the surface of the backplate, depending upon the material composition the backplate, adhesive and hole repair material. This feature functions to facilitate the application of hole repair material to the backplate and functions to improve the uniformity of hole repair material distribution throughout the cavity. In this example, hole repair material 901 is plaster of paris, which will adhere well to the plaster of the side walls of the cavity being filled. This adhesion around the edges of the cavity is complemented by adhesion of the hole repair material 901 to the front face 204 of backplate 202, helping to support the material during curing.

Figure 13:
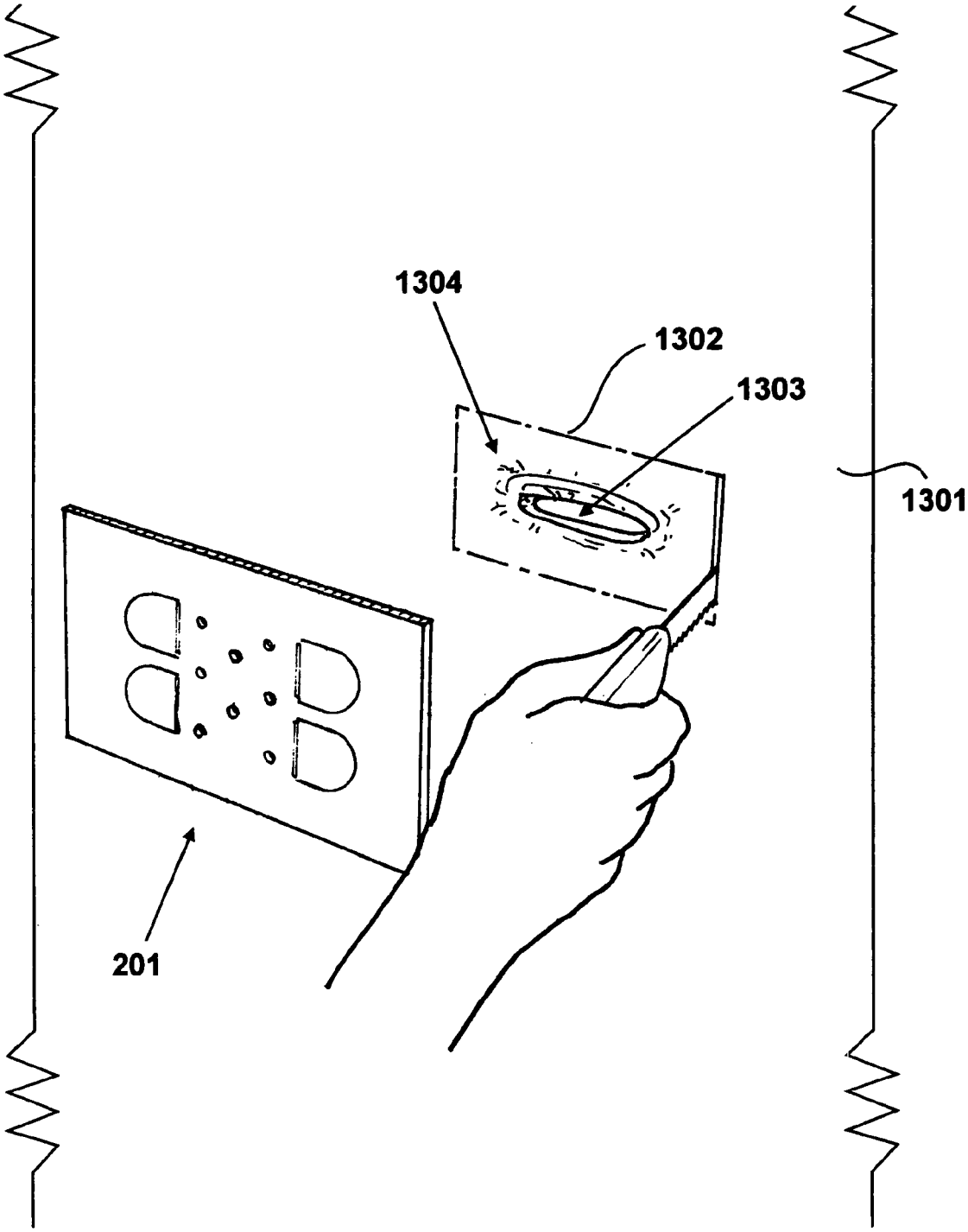
FIG. 13 illustrates a second example of a repair using a repair apparatus.

FIG. 13 illustrates a patch 1301 in a plaster board wall 1302 requiring repair. The patch 1301 defines an irregular shaped hole 1303. In this example, the patch 1301 represents crush damage to the wall 1301. Such damage may result from mishandling or impact, for example by a forklift truck. The paper covering of the wall 1302 has ripped, the edges of the hole 1303 are distressed and the inside face of the hole 1303 has partially collapsed around the edges. Thus, the damage has lessened the integrity of the wall strength.

To prepare the wall 1302 for repair using repair apparatus 201, at least the whole damaged area is cut out from the wall 1302. This leaves behind a larger hole, indicated by dotted line 1304, around which the wall 1302 is undamaged. The repair apparatus 201 may then be installed as described with reference to FIGS. 3 to 8.

Figure 14:
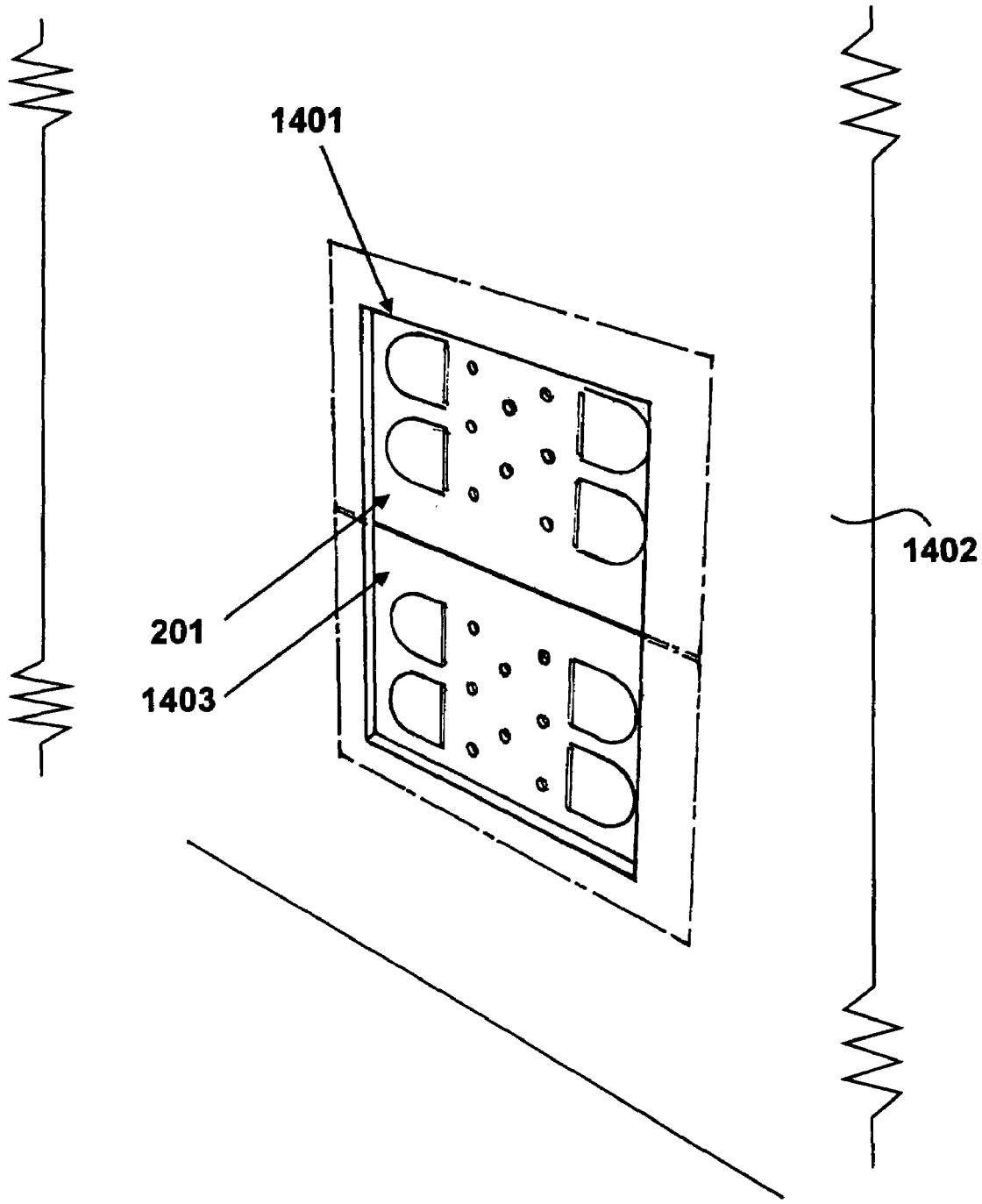
FIG. 14 illustrates a third example of a repair using a repair apparatus.

FIG. 14 illustrates a repair in an internal wall 1401, using repair apparatus 201. The size of the repaired hole 1402 in the wall is greater than that repairable by a single repair apparatus 201. However, repair has been achieved by using a second additional repair apparatus 1403. In this example, repair apparatus 1403 is identical to repair apparatus 201.

The backplates of the two repair apparatus 201, 1403 are mounted to the wall 1401 effectively by three sides each, and are positioned to lie alongside each other to provide a substantially continuous substrate surface.

Repair apparatus 201 is configured to be mounted to a wall effectively by only two sides of the backplate, allowing large holes in a building panel to be repaired using three or more repair apparatus. Such a hole may be left in a building panel following removal of, for example, an air vent or fuse box.

Figure 15:
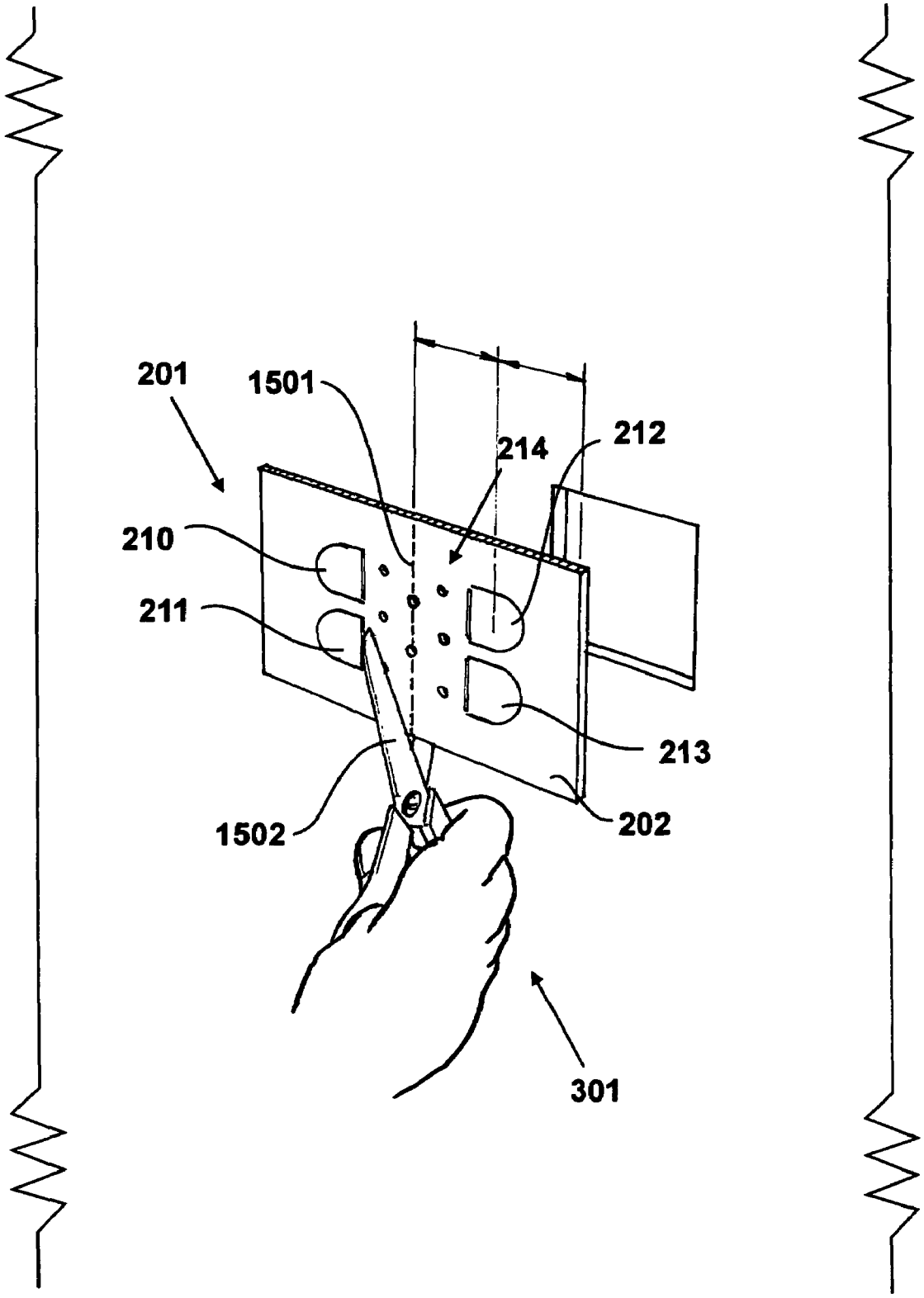
FIG. 15 shows the apparatus of FIG. 2 being divided into two smaller Backplates.

As shown in FIGS. 2 and 15, flaps 210, 211, 212, 213 of repair apparatus 201 are arranged substantially symmetrically about centerline 1501 of backplate 202, with each pair of flaps 210, 211 and 212, 213 located substantially centrally of each half of the backplate 202. Repair material aperture array 214 is located substantially symmetrically about centerline 1501.

With this arrangement, halving backplate 202 along centerline 1501 produces two substantially identical smaller backplates, each having a pair of flaps and a plurality of repair material apertures.

For example, backplate 202 may be dimensioned for use in repairing a hole in a building panel made by the removal of a double electrical socket fitting, and when halved provides two backplates each dimensioned for use in repairing a hole in a building panel made by the removal of a single electrical socket fitting.

Preferably, the backplate of the repair apparatus can be manually cut with a domestic purpose tool. The construction of backplate 202 allows building operative 301 to cut the backplate using a pair of domestic purpose scissors 1502, as shown.

To facilitate division, backplate 202 may be provided with one or more score lines, for example on the front face 204 along centerline 1501.

As previously described, the twin wall structure of backplate 202 comprises two walls spaced apart by connecting members extending therebetween. The arrangement of the connecting members may facilitate cutting in a particular direction and/or hinder cutting in a particular direction along the backplate.

Figure 16:
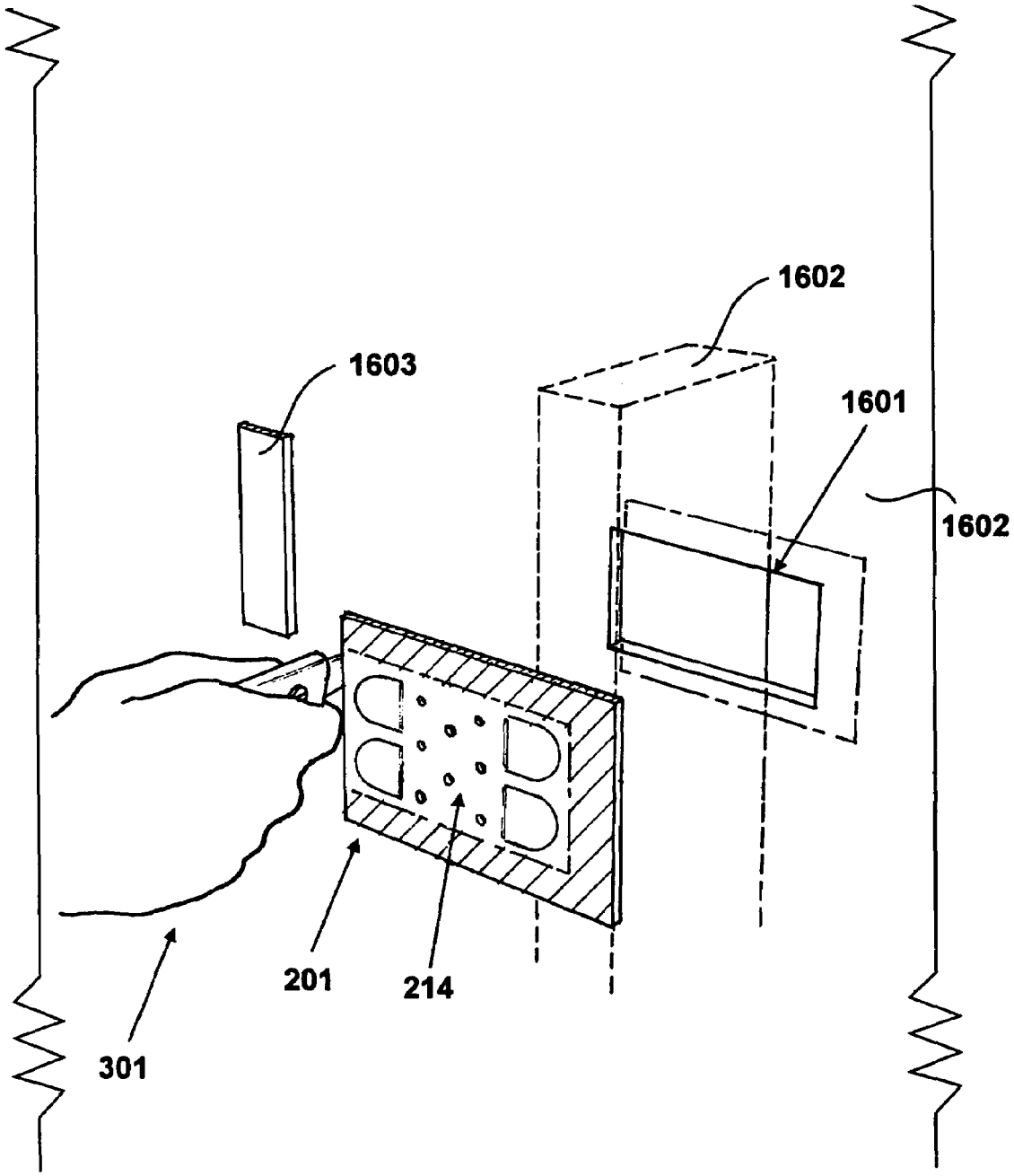
FIG. 16 shows the apparatus of FIG. 2 being trimmed.

Alternatively, as illustrated in FIG. 16, the backplate 202 of repair apparatus 201 can be cut with a knife. As described previously, substantially the whole of front face 204 is provided with adhesive. This feature enables the backplate 202 to be cut into any desired shape, and still be mountable to a building panel.

FIG. 16 illustrates a hole 1601 in a plasterboard wall 1602. Plasterboard walls are typically constructed on a timber frame, known as studding. A hole requiring repair may be formed in the wall immediately adjacent to a studding member which may potentially interfere with the installation of repair apparatus.

In FIG. 16, hole 1601 is immediately adjacent studding member 1602. In this example, trimming of one side of repair apparatus 201 is required to enable installation. As shown, building operative 301 has sliced off a portion 1603 of the backplate of repair apparatus 201 to enable the repair apparatus to be mounted to the wall 1601 such that the array of repair material apertures 214 is located substantially centrally of the hole 1601. As described with reference to FIG. 14, repair apparatus 201 is configured such that the mounting of the backplate following trimming is stable.

Figure 17:
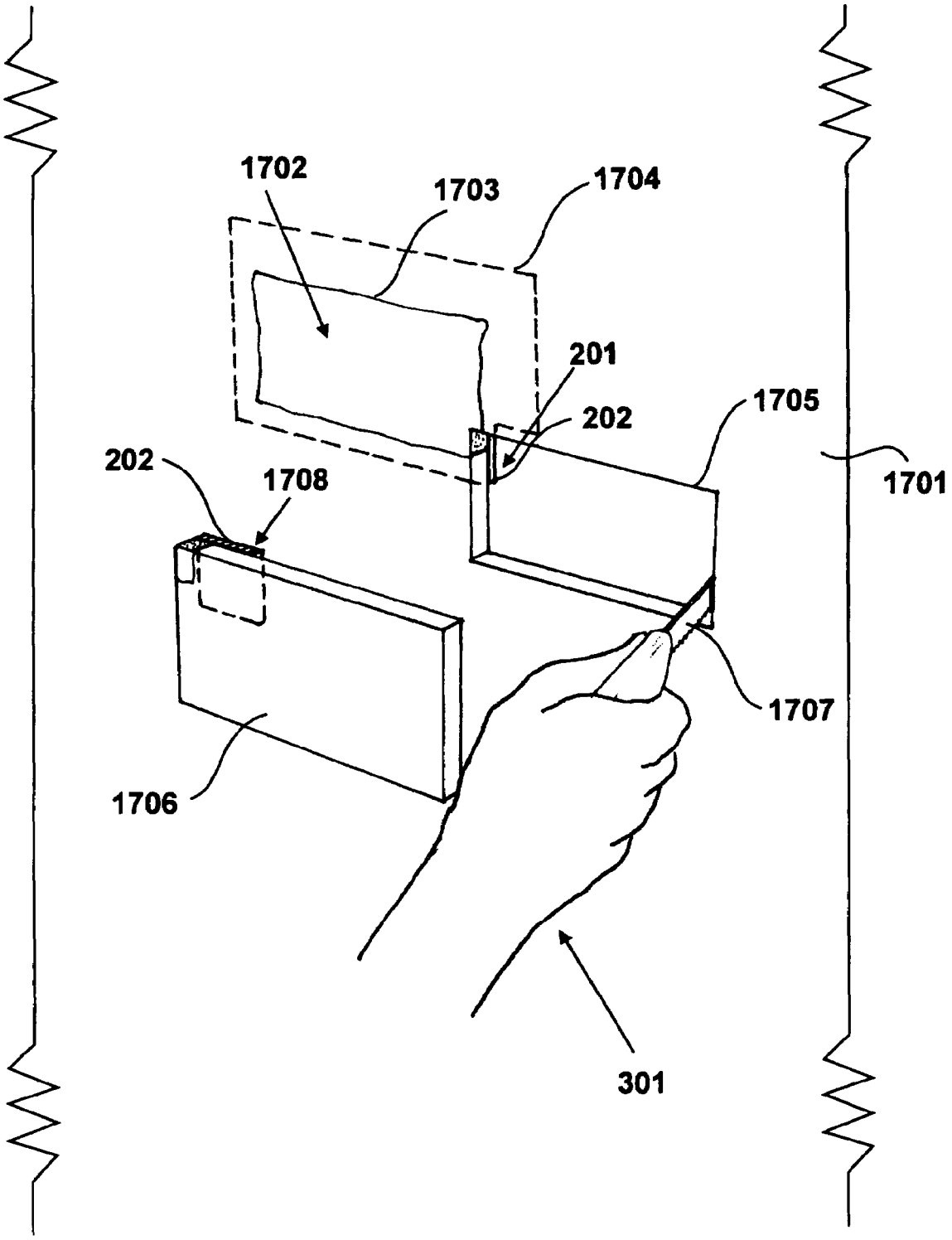
FIG. 17 shows an aperture being made in a second area that overlaps a first area of a building panel that has been repaired using the apparatus of FIG. 2.

FIG. 17 shows a building panel 1701 having a prior repair 1702, in which an aperture, indicated by line 1703, has been repaired using repair apparatus 201, the mounted position of which is indicated by dotted line 1704. A new aperture is required in the building panel 1701, for example to allow fitting of an electrical socket. in this example, the boundary of the required new aperture, indicated by line 1705, overlaps the mounted backplate 202 of the prior repair 1702. However, there is no problem in defining the new aperture since backplate 202 can be manually cut.

As shown, building operative 301 can create the required aperture in building panel 1701 by cutting out building panel portion 1706 bounded by hole perimeter line 1705, in this example using a saw 1707 or similar tool, and cutting off the overlapped portion 1708 of backplate 202.

Thus, the repair apparatus allows an aperture in a building panel to be relocated from a first area to a second area that overlaps the first area, following repair of the first area using the repair apparatus.

Figure 18:
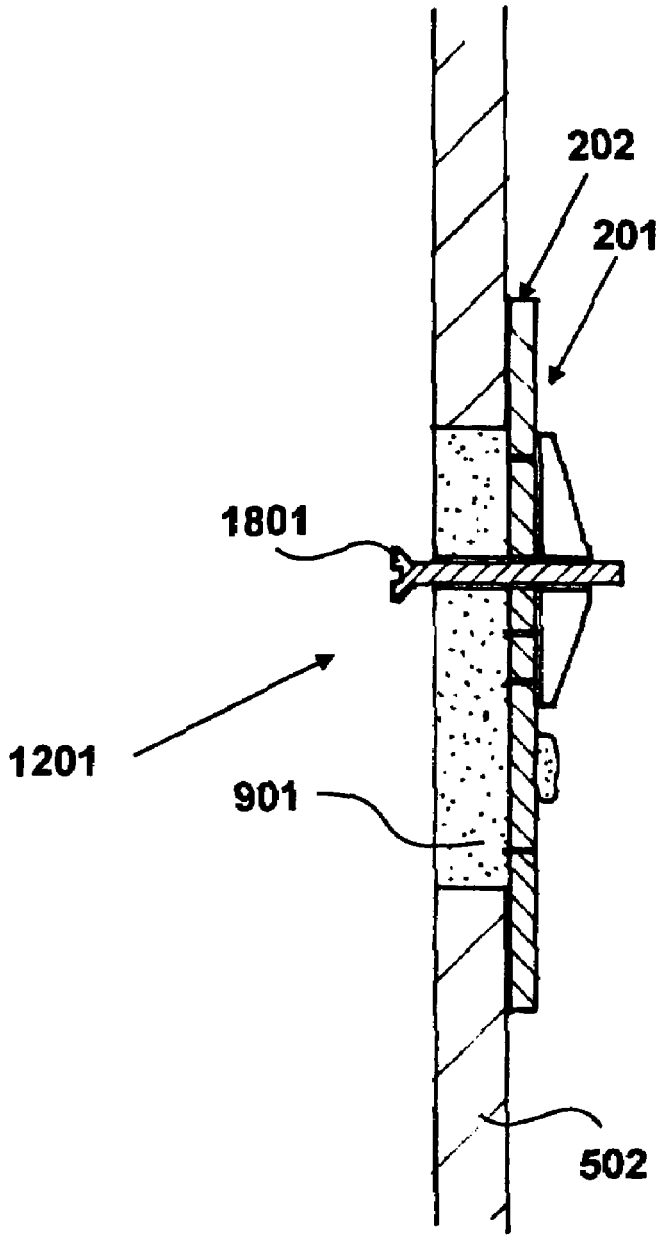
FIG. 18 shows a cross-section view of a repair through which a mounting member has been located.

FIG. 18 shows a cross-section view of repair 1201. As shown, the repair 1201 allows a mounting member, such as screw 1801, to be used in that area of the building panel. The hole repair material 901 allows penetration by a mounting member. The backplate 202 of the repair apparatus 201, which is effectively incorporated into the building panel structure, may be punctured by a mounting member such that the backplate 202 does not present a blockade to the mounting member. The integrity of the repair 1201 is sufficient to withstand, for example, a picture being mounted on the wall 502 using a mounting member installed in the repair 1201.

Figure 19:
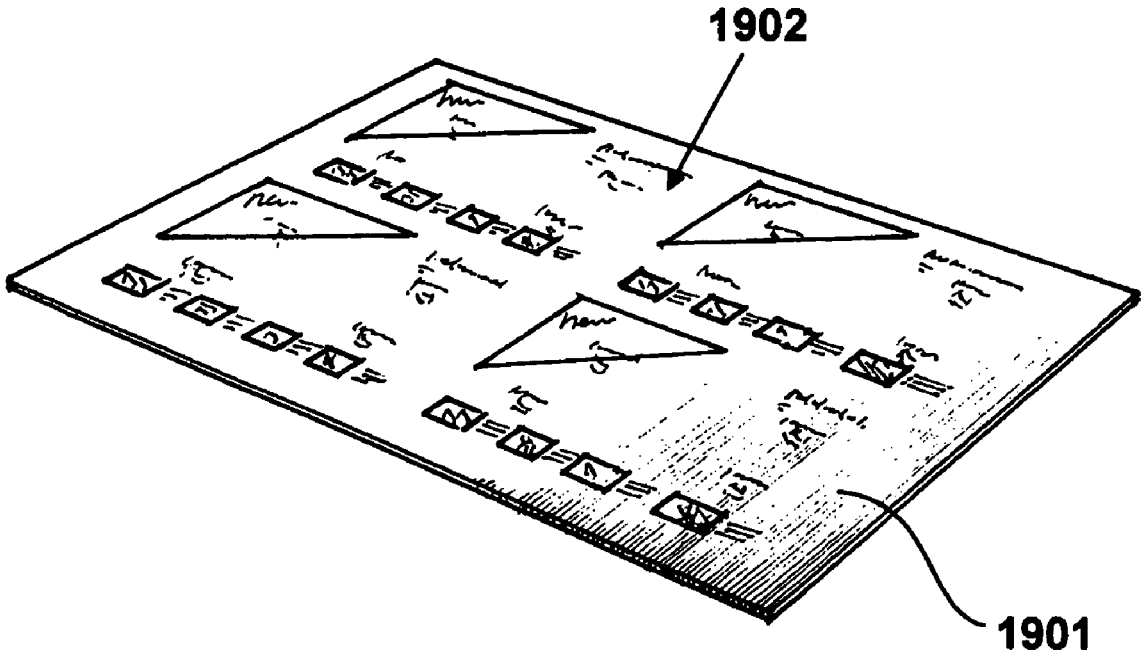
FIG. 19 shows a first step in the manufacture of the apparatus of FIG. 2.

FIG. 19 shows a first step in the manufacture of a repair apparatus. A backplate sheet 1901 is positioned to receive visual graphics, thereafter applied to a rear face 1902 thereof. In this example, a plurality of backplates is produced from backplate sheet 1901.

Preferably, the backplate sheet is fabricated from a material that is lightweight, to facilitate transport and manual handling of the resultant repair apparatus, and to reduce strain on the mounting of a backplate to a building panel.

Preferably, the backplate sheet material is relatively inflexible, to provide the repair apparatus with a backplate presenting in use a stable substrate surface for hole repair material. Preferably, however, the backplate sheet material can tolerate a degree of flexing, to reduce cracking of the resultant repair apparatus and to facilitate mounting of a backplate to a building panel.

Preferably, the backplate sheet material is water impermeable, to reduce the risk of water damage of the repair apparatus during transport or use. Furthermore, this feature functions to reduce dehydration of applied hole repair material, which can result in cracking in the cured hole repair material.

Preferably, the backplate sheet material allows the backplate to be manually cut using a domestic purpose tool. A suitable thickness of a backplate sheet to produce a backplate suitable for domestic use is in the range 3.5-6.5 mm. The dimensions provided herein are for purposes of illustration only as the particular dimensions may vary depending on the requirements of the particular application in which the apparatus will be used.

As previously described, backplate 202 of repair apparatus 201 is fabricated from twin wall plastic board. A suitable twin wall plastic board having a polypropylene component is available under the tradename Correx™ from D S Smith Plastics, England. This product displays preferred characteristics described above. Polypropylene is resistant to water, dirt or chemical ingress. The high strength to weight ration of polypropylene provides a board that is resistant to bending and deformation and is sufficiently robust to withstand conditions typically encountered in a building site environment. However, polypropylene based board is relatively easy to die cut and provides for cost effective small volume manufacture; at present die cutting process tooling is relatively inexpensive compared to plastic injection molding tooling. Further, the use of polypropylene in the building industry is favored due to the material being recyclable. Alternative suitable backplate materials include cardboard, laminated card and plywood, among other suitable materials.

The application of visual graphics, for example illustrated instructions for use, may be performed by a screen-printing process, a lithoprinting process or by the application of stickers or transfers. Alternatively, a flexoprinting process, which utilizes rollers, may be used and at present this process is cheaper than screen-printing and lithoprinting processes. Polypropylene board is identified as being a workable material in surface printing applications.

Figure 20:
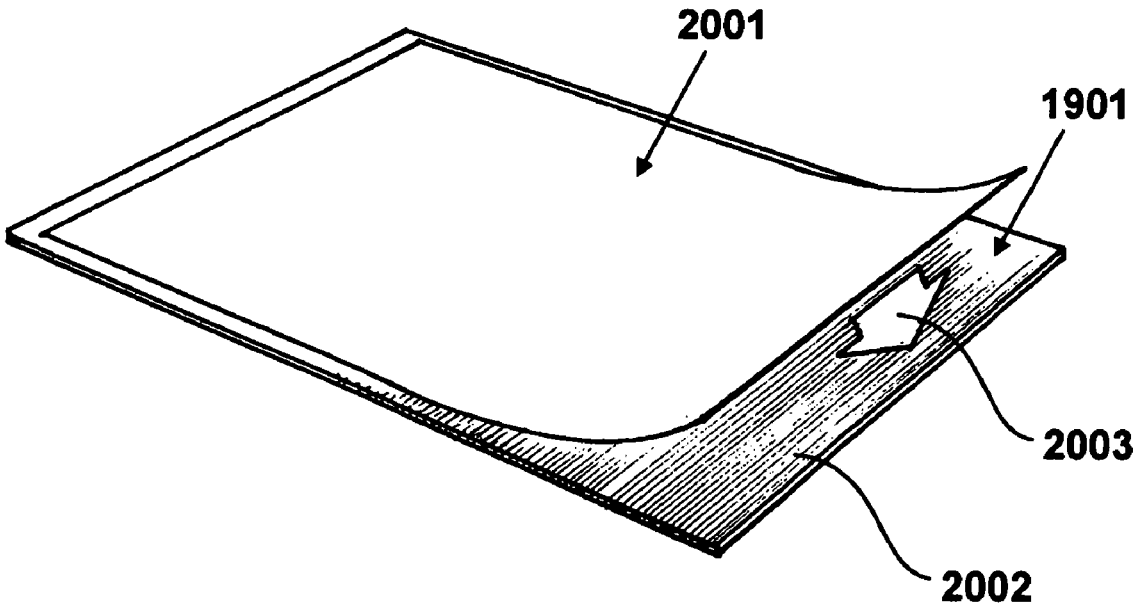
FIG. 20 shows a second step in the manufacture of the apparatus of FIG. 2.

FIG. 20 shows a second step in the manufacture of a repair apparatus. Adhesive 2001 is applied to the front face 2002 of backplate sheet 1901 (as indicated by arrow 2003). In this illustrated example, adhesive is distributed across substantially the whole of the front face 2002 of backplate sheet 1901, either as a substantially continuous or patterned layer. In accordance with the arrangement of adhesive of repair apparatus 201, substantially the whole of the front face of each backplate produced from backplate sheet 1901 will be provided with adhesive.

According to a first alternative arrangement of adhesive, the front face of a backplate is provided with adhesive along the edges only. According to a second alternative arrangement of adhesive, the front face of a backplate is provided with adhesive in each corner only.

As previously described, the front face 204 of backplate 202 is provided with two-sided adhesive tape. Suitable adhesive tape is available under the tradename 3M Scotch 300 LSE (low surface energy) high strength adhesive tape available from Parafix Tapes & Conversions Limited, United Kingdom and most major tape suppliers. Preferably, the depth and/or quality of the applied adhesive is sufficient to tolerate any dirt or debris on a mounting surface.

The adhesive applied to the backplate provides a bonding surface and provides a key for hole repair material. Additionally, hole repair material may adhere to the adhesive surface more strongly than to the surface of the backplate, depending upon the material composition of the backplate, adhesive and hole repair material. For example, bonding between hole repair material and adhesive is stronger than bonding between hole repair material and polypropylene. Thus, in embodiments utilizing Correx™ board, the adhesive improves the integrity of the repair.

Figure 21:
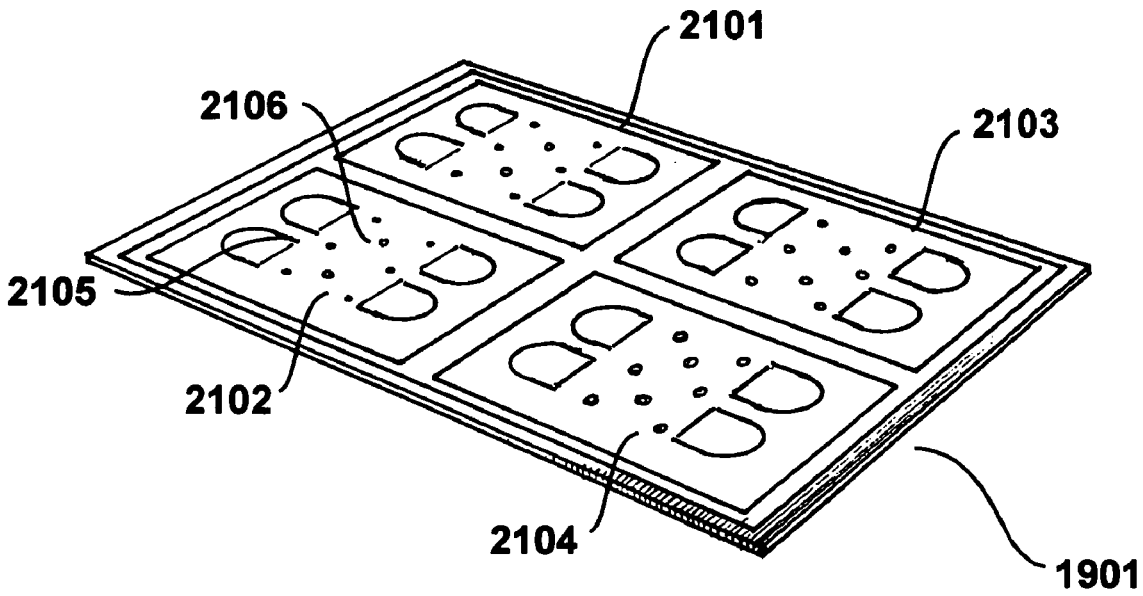
FIG. 21 shows a third step in the manufacture of the apparatus of FIG. 2.

FIG. 21 shows a third step in the manufacture of a repair apparatus. A plurality of backplates 2101, 2102, 2103, 2104 is defined in backplate sheet 1901. Each backplate 2101, 2102, 2103, 2104 has at least one flap, for example flap 2105, and additionally at least one repair material aperture, for example repair material aperture 2106.

Different arrangements of flaps to that illustrated in the accompanying figures are utilizable. For example, outwardly opening flaps may be defined in a backplate or flaps opening in different directions. The location of a flap or flaps defined in a backplate relative to another or edges of the backplate may also vary, and flaps of different sizes are utilizable.

Each of the defining cuts performed at this step may be achieved using a die cutting process. Cuts may be performed from either side of the backplate sheet. Cuts may be square through the backplate sheet, where the die cutting meets the board normal thereto, or cuts may be made at an angle to the board to form a chamfered edge, for example to assist in the creation of flaps with a directional fold. Alternatively, chamfered edges may be formed by a plastic injection molding process.

Flaps with directional folds may be formed in a twin wall plastic backplate by the stamping of a crease on one side of the backplate only during the die cutting process, the blade of the die cutting tool deforming the material rather than cutting completely through it.

Preferably, the diameter of a repair material aperture is in the range 4.5-8.5 mm. An array of repair material apertures may be formed from apertures having different diameters. Suitable width and length dimensions for a backplate for use in repairing a hole in a building panel made by the removal of a double electrical socket fitting are approximately 120 mm and 180 mm respectively. To repair a hole in a building panel having width and length dimensions up to 0.1016 m square, a backplate having width and length dimensions of 0.1524 m square would be sufficient. The dimensions provided herein are for purposes of illustration only as the particular dimensions may vary depending on the requirements of the particular application in which the apparatus will be used.

Figure 22:
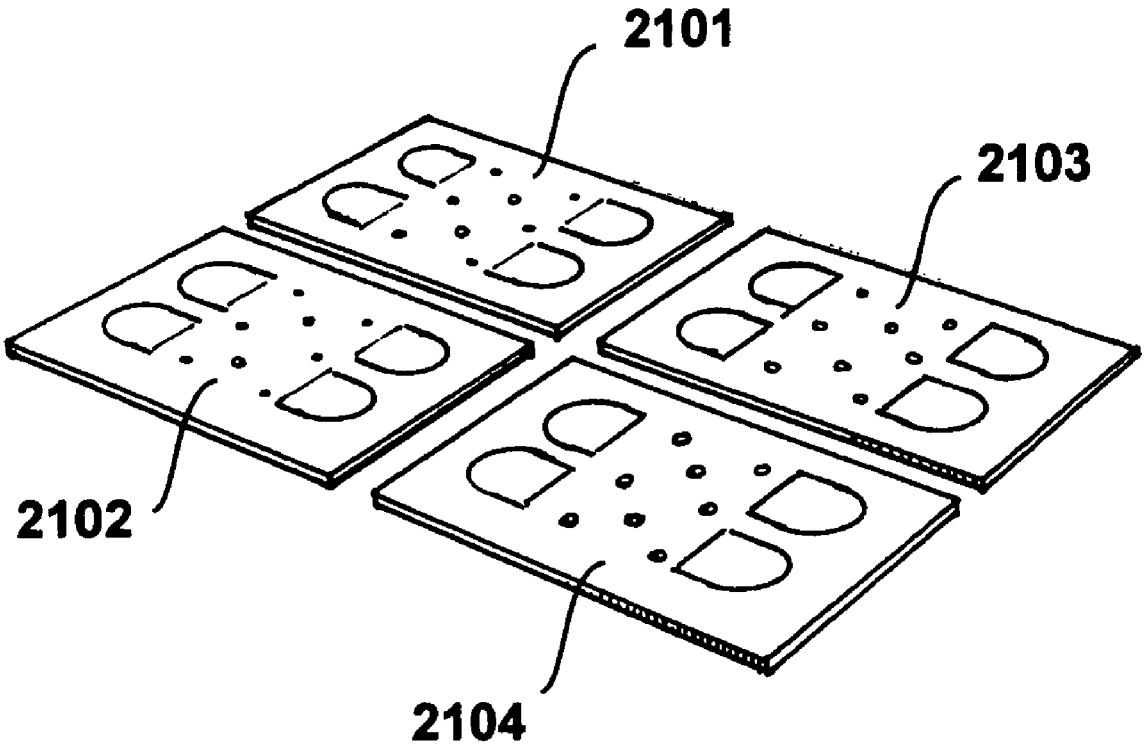
FIG. 22 shows a fourth step in the manufacture of the apparatus of FIG. 2.

FIG. 22 shows a fourth step in the manufacture of repair apparatus 201. The backplates 2101, 2102, 2103, 2104 are separated from backplate sheet 1901. This may be achieved using a suction or stamping process.

Removal of areas of a backplate, for example the removal of material to form a repair material aperture, may be performed using a suction or stamping process or may be performed manually. Thus, removal of backplate material may be performed prior to packaging or retail or may be left for a building operative to remove prior to use.

Figure 23:
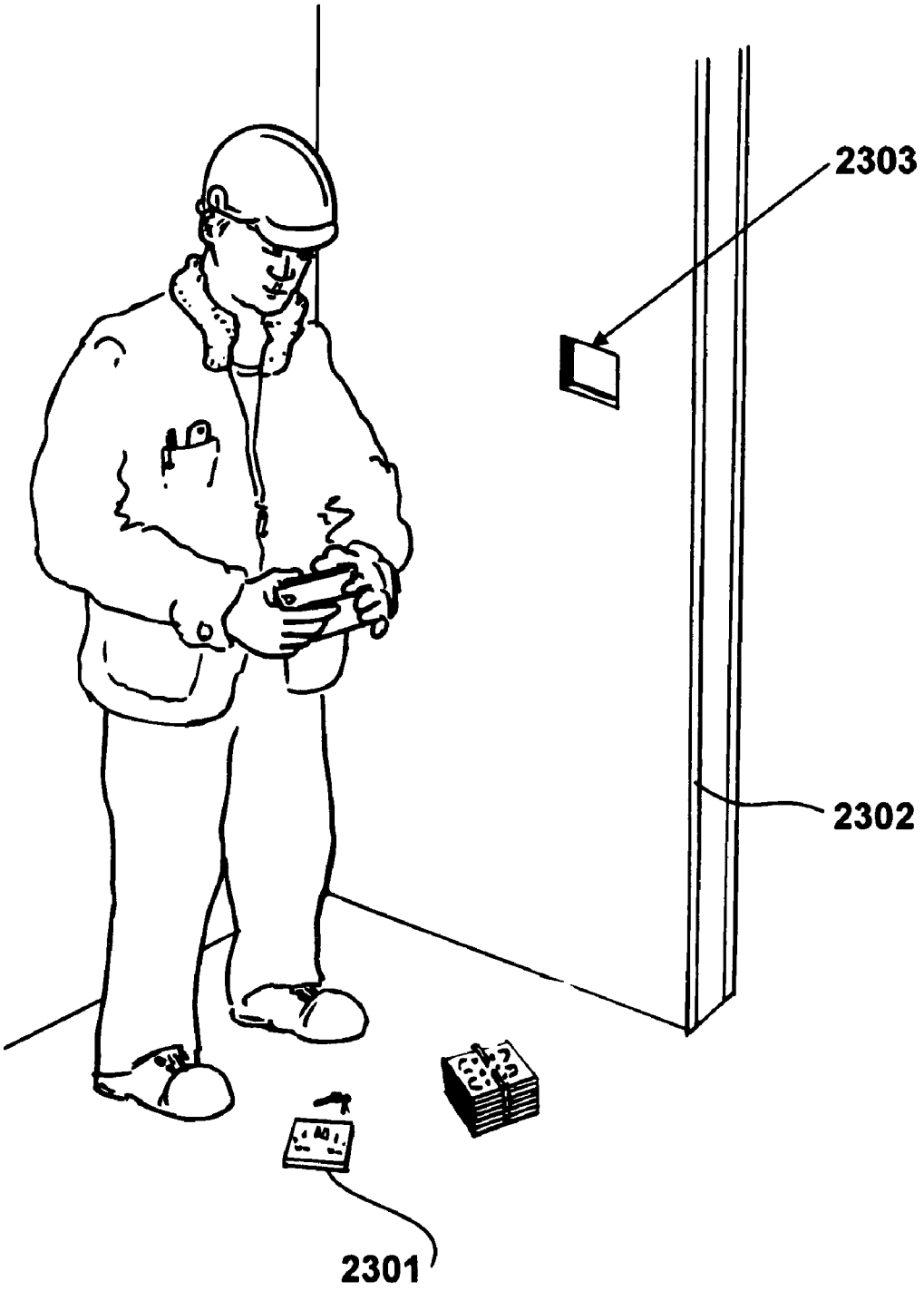
FIG. 23 shows a repair apparatus having a square rectangular shape.

A repair apparatus 2301 having a square rectangular shape is shown in FIG. 23. In a similar scenario to that shown in FIG. 1, a wall 2302 has a hole 2303 therein requiring repair.

Figure 24:
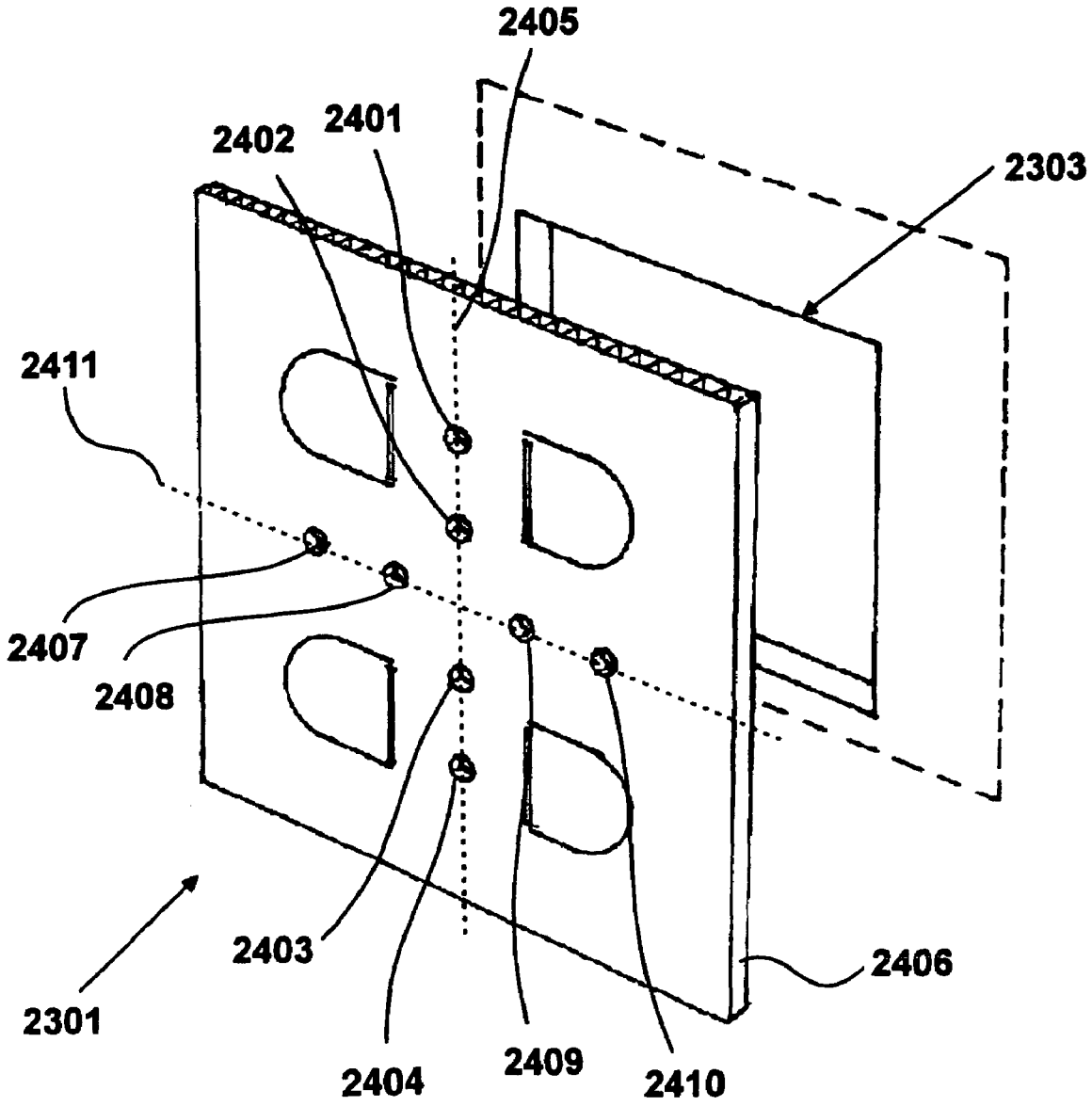
FIG. 24 shows the repair apparatus of FIG. 23 in further detail.

FIG. 24 shows an enlarged view of repair apparatus 2301. In this example, the repair apparatus has length and width dimensions of six inches (~0.1524 m) square. This size of backplate is suitable for repairing aperture 2303, which in this example has length and width dimensions of four inches (~0.1016 m) square.

Repair apparatus 2301 defines repair material apertures including a plurality of repair material apertures aligned along a first axis such that the backplate is predisposed to bend along the first axis.

It can be seen from FIG. 24 that repair material apertures 2401, 2402, 2403 and 2404 each lie upon the same bend axis 2405 of backplate 2406. In this example, first bend axis 2405 is a centerline of backplate 2406. The provision of apertures aligned along an axis introduces a line of weakness to the backplate that renders the backplate less resistant to folding, to the effect that the backplate will tend to flex along the weakened axis.

A repair apparatus may be provided with apertures aligned to form more than one bend axis. For example, repair material apertures 2407, 2408, 2409 and 2410 of repair apparatus 2301 are aligned along second bend axis 2411 of backplate 2406. Second bend axis 2411 extends in a direction perpendicular to bend axis 2405, and the bend axes 2405 and 2411 intersect. In an alternative arrangement, a repair material aperture is provided at the point of intersection of bend axes. It is to be appreciated that different arrangements of apertures may be utilized to provide different arrangements of bend axes. For example, a repair apparatus may be provided with a plurality of bend axes that do not intersect.

Figure 25:
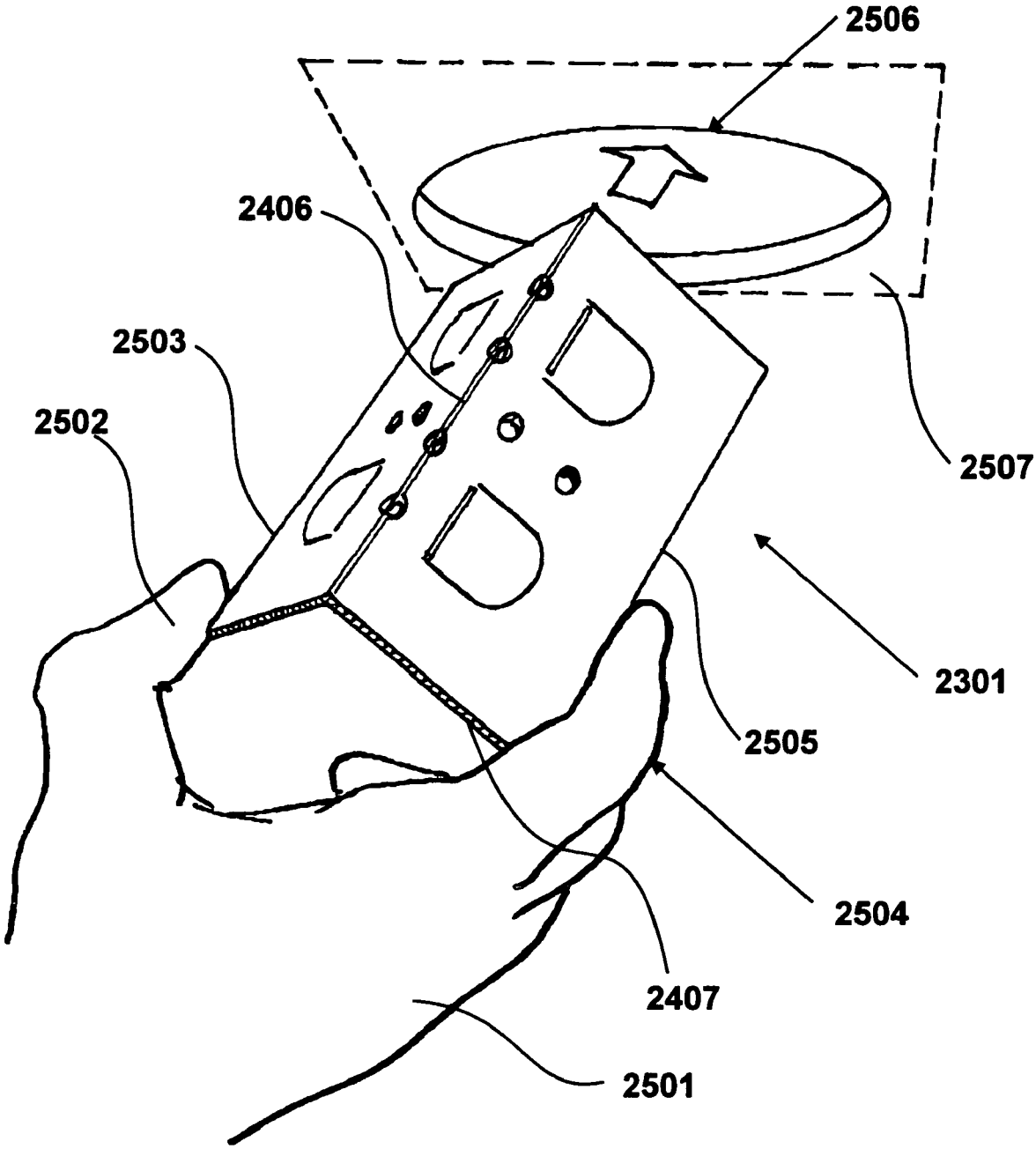
FIG. 25 shows repair apparatus having flexed in response to manually applied pressure.

FIG. 25 shows repair apparatus 2301 responding to manually applied pressure. Repair apparatus 2301 is being held in one hand 2501 only, gripped between the thumb 2502, which is in contact with a first edge 2503 of the backplate 2407, and the fingers 2504, which are in contact with the opposite edge 2505 of the backplate 2407. Under a squeezing action effected by hand 2501, the backplate of the repair apparatus flexes to fold along bend axis 2406, which extends between the opposite edges 2503, 2505.

In some situations, flexing of a repair apparatus facilitates insertion of the repair apparatus through an aperture in a building panel. The provision of a bend axis, through the positioning of apertures in the backplate, confers control to an operative over the bending or flexing of the repair apparatus. This feature serves to add to the convenience of using the repair apparatus.

In the example of FIG. 25, the bending of backplate 2407 enables the repair apparatus 2301 to be inserted through a circular aperture 2506 in a building panel 2507 that has a diameter which is less than the minimum measurement across the backplate 2407. Thus, in some cases the bend axis feature of the repair apparatus serves to reduce the amount of preparation prior to performing repair of a building panel using the repair apparatus. The bend feature may obviate a necessity to either increase the size of an aperture to be repaired or reduce the size of the repair apparatus. This feature is particular useful when repairing apertures having an irregular shape.

In some circumstances it is desirable for an inner region of a repair apparatus to be removed, for example to accommodate a pipe or other obstacle extending behind the building panel being repaired. A repair apparatus may have the perimeter of at least one region of the backplate delineated to facilitate manual removal of that region from the backplate. The perimeter of a region of the backplate may be delineated by a visual representation, such as a continuous line, and/or by perforations and/or by scoring. The perimeter of a region may be marked out on the front face of the backplate, for example on the removable backing, or on the rear face of the backplate. The same or different outlines may be presented on the front and rear faces of the backplate.

Figure 26:
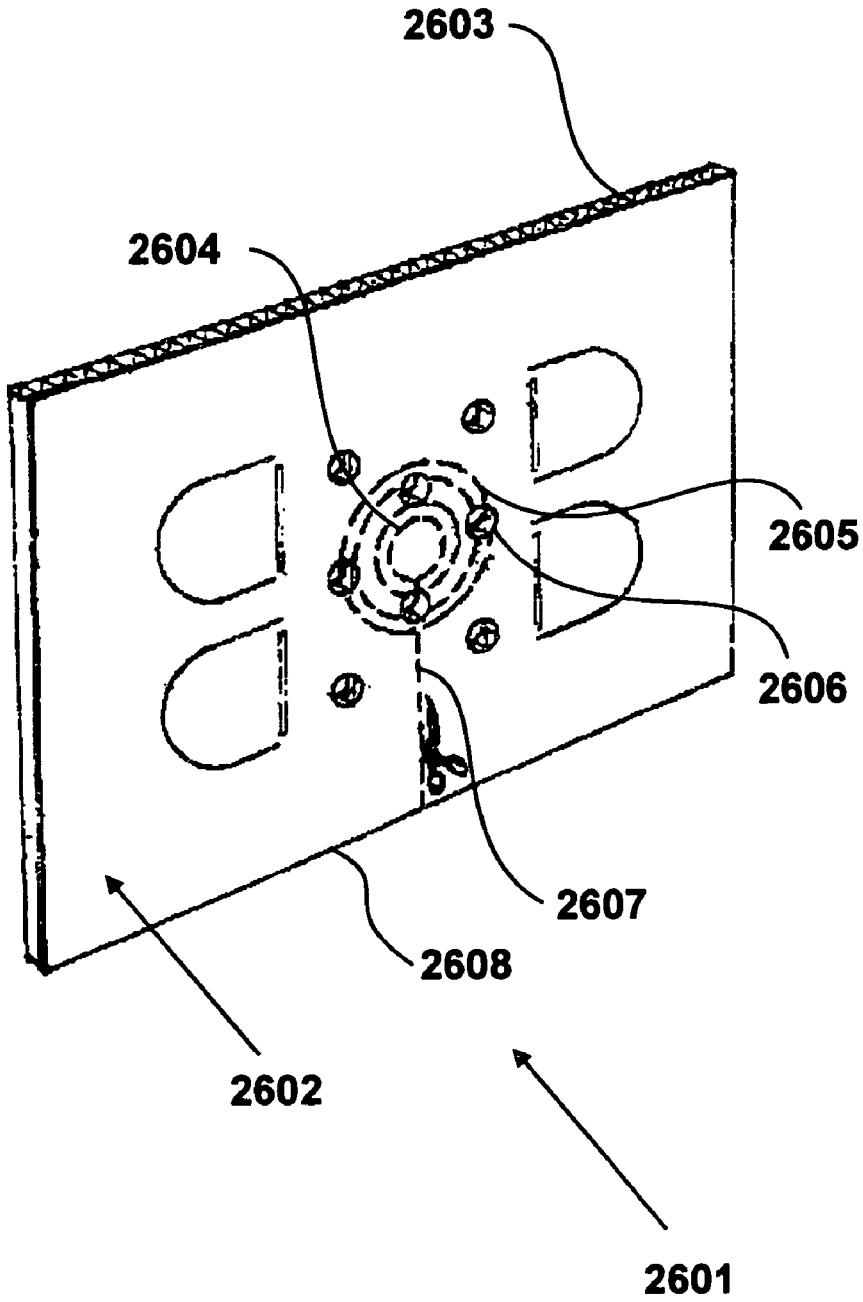
FIG. 26 shows a repair apparatus having the perimeter of at least one region of the backplate delineated.

FIG. 26 shows a repair apparatus 2601. On the front face 2602 of the backplate 2603, the perimeter of each of a plurality of concentric circular regions is delineated.

In this example, the smallest circle 2604 is substantially central of the backplate 2603 and the perimeter of each of some of the larger circles extend across repair material apertures defined in the backplate 2603, for example the perimeter of circle 2605 extends across repair material aperture 2606.

A line 2607 is also presented on the front face 2602 of the backplate 2603 that extends from an edge 2608 of the backplate 2603 to the smallest circle 2604, indicating a cut line to facilitate cutting out of an inner region of the backplate.

It is to be appreciated that different repair apparatus may have different arrangements of regions outlined, including different shapes, sizes and overlapping of different outlines. The outlining of a cut line and inner region(s) of the backplate assists an operative in cutting out the desired shape neatly. An inner region may be cut using scissors, a knife or other cutting tool.

Figure 27:
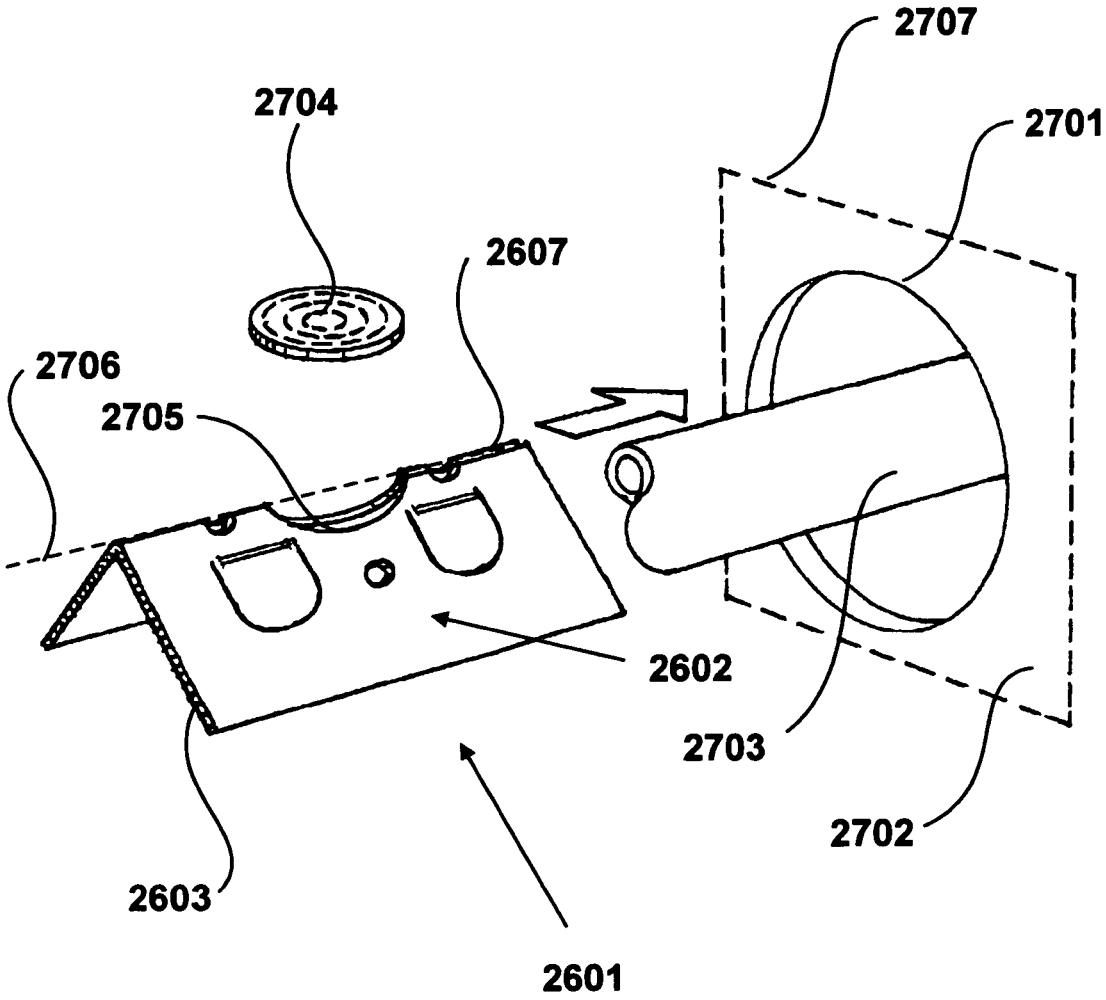
FIG. 27 shows the repair apparatus of FIG. 26 prepared for use in the repair of a building panel behind which an obstacle extends.

FIG. 27 shows repair apparatus 2601 prepared for use in the repair of an aperture 2701 in a building panel 2702 through which a utility pipe 2703 extends.

Preparation of the repair apparatus 2601 includes the steps of cutting along line 2607, cutting out and removing an inner region 2704 of the backplate 2603 to leave behind an aperture 2705, and exposing the adhesive on the front face 2602 of the backplate. With the inner region 2704 of the backplate 2603 removed, the backplate 2603 can be located behind the building panel 2702 around the utility pipe 2703.

The backplate 2603 is shown folded along a bend axis 2706, which extends through the aperture 2705. Whilst bent, the repair apparatus 2601 can be inserted into the aperture 2701 in the building panel 2702 to one side of the utility pipe 2703, in this illustrated example over the top of the pipe 2703. The backplate 2603 can then be located around the utility pipe 2703 by spreading out the parts of the backplate 2603 either side of the cut line 2607 and manipulating the backplate 2603 to bring these parts around either side of the pipe 2703.

The repair apparatus 2601 may then be positioned against the rear surface of the building panel 2702 and secured as previously described. Dotted line 2707 around aperture 2701 in building panel 2702 indicates the finish position of the backplate 2603 relative to the aperture 2701.

As illustrated in FIG. 1, a plurality of repair apparatus may be joined together, for convenient transport and storage. A plurality of repair apparatus may be tied together by a cord or tie-wrap threaded through a flap aperture in each repair apparatus. A plurality of repair apparatus each defining at least one repair material aperture may be joined together on a cord or a tie-wrap threaded through a repair material aperture in each repair apparatus. Alternatively, a two-piece fastener may be used. Such a fastener may be an injection molded polythene stud fastener having a male connecting part that releasably connects to a female connecting part. Using a fastener having a repeatedly separable/connectable part to group a plurality of repair apparatus together allows an operative to disconnect the part, remove a repair apparatus, and then group the remaining repair apparatus together using the same fastener, by reconnecting the part. A repair material aperture or flap aperture in a backplate may also be used to hang the repair apparatus in a retail or storage environment.

Thus, the repair apparatus is convenient for an operative to transport and store and is quick and easy to use. The simplicity of the construction of the repair apparatus and the quick and simple associated method of use is advantageous in poor light conditions and cluttered environments.

The repair apparatus functions to provide a substantially planar uniform substrate surface on which to apply hole repair material. This feature functions to provide the cavity to be filled with a uniform depth, to reduce cracking of applied hole repair material during curing caused by different curing rates within the cavity due to different depths of hole repair material within the cavity. The uniformity of the substrate surface functions to facilitate the application of a regular distribution of hole repair material within the cavity. This feature provides the advantage that the quantity of hole repair material required to fill the hole can be more accurately determined prior to the repair being carried out.

The repair apparatus provides a relatively inflexible substrate surface to support hole repair material. It is desirable to reduce movement of the substrate surface that will result in cracking of applied hole repair material. For example, flexing of a mounted backplate may weaken the security of the mounting of the backplate to the building panel, which in turn may result in the repair being more susceptible to post repair damage caused by the repair failing under force applied thereto.

The building operative practiced in the use of the repair apparatus will become knowledgeable regarding the time required to install the repair apparatus, the quantity of hole repair material required to complete a particular type of repair, the consistency of the hole repair material to be used for ease of application and to avoid cracking during curing, and the cure time of a particular type of building panel repair. Thus, the repair apparatus is configured to reduce variability in performing building panel repair and improve the reliability of the repair. This provides increased control over the duration to complete a repair, the quality of a repair and the cost per repair.

Preferably, the repair apparatus is manufactured to be applicable for use in providing a repair that would conform to one-hour fire rating regulations with a dry patch repair. To achieve this, a repair compound suitable for such purpose should be used.

All dimensions provided herein are for purposes of illustration only as the particular dimensions may vary depending on the requirements of the particular application in which the apparatus will be used.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present invention and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. Apparatus for use in building panel repair comprising a substantially planar backplate for insertion through a hole in a building panel to be repaired, the backplate has a front face that is provided with adhesive for mounting the backplate to the rear side of a building panel, and the backplate defines at least one flap that is movable between:

an open position leaving a flap aperture within said backplate for providing an operative with backplate positioning means to facilitate mounting of the backplate to a building panel;

a closed position in which said at least one flap closes said flap aperture;

the front face of the at least one flap is provided with adhesive;

wherein at least one repair material aperture is defined in said backplate for receiving curable hole repair material; and wherein said backplate defines a plurality of repair material apertures aligned along a first axis such that said backplate is predisposed to bend along said first axis.

2. Apparatus according to claim 1 wherein said backplate is configured such that said at least one flap has a directional fold to inhibit said at least one flap from being movable from said closed position through said backplate to an open position on a rear face side of said backplate.

3. Apparatus according to claim 1, wherein said backplate has a centerline and a first flap is defined on one side of said centerline of said backplate and a second flap is defined on the other side of said centerline of said backplate.

4. Apparatus according to claim 3 wherein said backplate defines a first pair of flaps on one side of said centerline of said backplate, and a second pair of flaps on the other side of said centerline, the flaps of each of said first pair and said second pair open in the same direction as each other, and the flaps of said first pair open in a different direction to the flaps of said second pair.

5. Apparatus according to claim 4 wherein said flaps open inwardly towards the center of the backplate.

6. Apparatus according to claim 1 wherein said backplate has a rectangular shape.

7. Apparatus according to claim 1 wherein said adhesive comprises two-sided adhesive tape having one side adhered to the front face of said backplate and the opposite side for adhering to a building panel being provided with a removable backing.

8. Apparatus according to claim 1 wherein adhesive is distributed across substantially the whole of the front face of said backplate.

9. Apparatus according to claim 1 wherein said backplate is fabricated from water impermeable material.

10. Apparatus according to claim 1 wherein said backplate is fabricated from plastic.

11. Apparatus according to claim 10 wherein said backplate is fabricated from twin wall polypropylene board.

12. Apparatus for use in building panel repair comprising a substantially planar backplate for insertion through a hole in a building panel to be repaired, the backplate has a front face that is provided with adhesive for mounting the backplate to the rear side of a building panel, and the backplate defines at least one flap that is movable between:

an open position leaving a flap aperture within said backplate for providing an operative with backplate positioning means to facilitate mounting of the backplate to a building panel;

a closed position in which said at least one flap closes said flap aperture;

the front face of the at least one flap is provided with adhesive; and wherein at least one region of said backplate has a perimeter that is delineated by means of at least one of: a visual representation, perforations and a score line, to facilitate manual removal of said region from the backplate.

13. Apparatus according to claim 12 wherein each of a plurality of concentric circular regions of said backplate has a perimeter that is delineated.

14. Apparatus for use in building panel repair comprising a substantially planar backplate for insertion through a hole in a building panel to be repaired, the backplate has a front face that is provided with adhesive for mounting the backplate to the rear side of a building panel, and the backplate defines at least one flap that is movable between: an open position leaving a flap aperture within said backplate for providing an operative with backplate positioning means to facilitate mounting of the backplate to a building panel;

a closed position in which said at least one flap closes said flap aperture;

the front face of the at least one flap is provided with adhesive; and at least one score line across said backplate to facilitate division of said backplate.

15. A method of building panel repair using apparatus comprising a substantially planar backplate for insertion through a hole in a building panel to be repaired, the backplate has a front face that is provided with adhesive for mounting the backplate to a rear face of a building panel; and the backplate defines at least one flap that is movable between an open position leaving a flap aperture within said backplate for providing an operative with backplate positioning means to facilitate mounting of the backplate to a building panel, and a closed position in which said flap closes said flap aperture, said method comprising the steps of:

inserting the backplate through a hole in a building panel;

with a flap in said open position, positioning the front face of said backplate to face the rear face of said building panel;

with the adhesive provided on the front face of the backplate exposed, pulling the front face of the backplate against the rear face of the building panel to mount said backplate;

moving said flap into said closed position; and applying hole repair material to material apertures of the exposed surface of the mounted backplate.

16. A method according to claim 15 wherein said adhesive comprises two-sided adhesive tape having one side adhered to the front face of said backplate and the opposite side for adhering to a building panel being provided with a removable backing, and said method further comprises the step of removing said removable backing.

17. A method according to claim 15 wherein said backplate defines a plurality of repair material apertures aligned along a first axis such that said backplate is predisposed to bend along said first axis and said method further comprises the step of bending said backplate along said first axis to facilitate inserting the backplate through a hole in a building panel.

18. A method according to claim 15 wherein a region of said backplate has a perimeter that is delineated to facilitate manual removal of said region from the backplate and said method further comprises the step of removing said region from said backplate.

19. A method of manufacturing apparatus comprising a substantially planar backplate for insertion through a hole in a building panel to be repaired, the backplate has a front face that is provided with adhesive for mounting the backplate to a rear face of a building panel; the backplate defines at least one flap that is movable between an open position leaving a flap aperture within said backplate for providing an operative with backplate positioning means to facilitate mounting of the backplate to a building panel, and a closed position closes said flap aperture, and the front face of at least one flap is provided with adhesive, said method comprising the steps of:

adhering one side of two-sided adhesive tape to one side of a backplate sheet; and cutting along a score line through said backplate sheet to define a backplate having a front face and defining at least one flap having said adhesive tape thereon, and wherein adhesive tape is distributed across substantially the whole of the front face of said backplate.

20. A method according to claim 19 wherein a plurality of flaps is defined and said method further comprises the step of dividing the backplate sheet into a plurality of said flaps.

* * * * *